US010359729B2

(12) United States Patent
Ichihashi et al.

(10) Patent No.: US 10,359,729 B2
(45) Date of Patent: Jul. 23, 2019

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Naoaki Ichihashi, Kashiwa (JP); Yasuhiro Kawai, Abiko (JP); Kenichi Ikari, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/155,126

(22) Filed: Oct. 9, 2018

(65) Prior Publication Data

US 2019/0113879 A1 Apr. 18, 2019

(30) Foreign Application Priority Data

Oct. 16, 2017 (JP) ..... 2017-200547

(51) Int. Cl.
*G03G 5/00* (2006.01)
*G03G 15/00* (2006.01)
(Continued)

(52) U.S. Cl.
CPC ..... *G03G 15/751* (2013.01); *G03G 5/0525* (2013.01); *G03G 5/0596* (2013.01);
(Continued)

(58) Field of Classification Search
CPC ..... G03G 5/0525; G03G 5/0596; G03G 5/14795; G03G 15/751; G03G 15/754; G03G 2215/00957; G03G 21/0011
See application file for complete search history.

(56) References Cited

U.S. PATENT DOCUMENTS 5,773,175 A * 6/1998 Taniguchi ..... G03G 5/04 430/130
5,842,962 A * 12/1998 Yamada ..... B23P 11/025 492/18

(Continued)

FOREIGN PATENT DOCUMENTS

JP 4059518 3/2008
JP 2016-218318 12/2016

*Primary Examiner* — David J Bolduc
(74) *Attorney, Agent, or Firm* — Venable LLP

(57) ABSTRACT

There is provided an electrophotographic photosensitive member having a cylindrical shape, including a plurality of concave portions on a surface thereof, wherein a sum of opening areas of the concave portions is 5% or more and 65% or less based on a total area of a surface layer of the electrophotographic photosensitive member, an average value davg of depths of the concave portions satisfies the following Equation (1), $$0.4 \leq davg \leq 3.0 (\mu m) \quad \text{Equation (1)}$$

a sum of opening areas of concave portions having a specific depth d is 95% or more of the sum of the opening areas of the concave portions, an average value Lavg of maximum widths of openings of the concave portions in a circumferential direction of the electrophotographic photosensitive member is 20 μm or more and 200 μm or less, and the electrophotographic photosensitive member has at least one specific region B.

5 Claims, 12 Drawing Sheets

(51) Int. Cl.
*G03G 5/05* (2006.01)
*G03G 21/00* (2006.01)
*G03G 5/147* (2006.01)

(52) U.S. Cl.
CPC ..... *G03G 15/754* (2013.01); *G03G 21/0011* (2013.01); *G03G 5/14795* (2013.01); *G03G 2215/00957* (2013.01)

(56) References Cited

U.S. PATENT DOCUMENTS 6,311,615 B1 * 11/2001 Hilliard ..... B41F 13/02 101/212
6,829,050 B2 * 12/2004 Ikeda ..... B29C 59/046 264/1.6
7,186,489 B2 * 3/2007 Uematsu ..... G03G 5/00 430/127
7,413,840 B1 * 8/2008 Ogaki ..... G03G 5/0525 430/132
7,551,878 B2 * 6/2009 Ogaki ..... G03G 5/0517 399/159
7,556,901 B2 * 7/2009 Anezaki ..... G03G 5/00 399/116
7,622,238 B2 11/2009 Uematsu et al.
7,629,102 B2 * 12/2009 Ochi ..... G03G 5/047 430/127
7,645,547 B2 * 1/2010 Okuda ..... G03G 5/147 399/159
7,655,370 B2 * 2/2010 Kitamura ..... G03G 5/047 430/58.05
7,718,331 B2 * 5/2010 Uematsu ..... G03G 5/00 430/56
7,749,667 B2 * 7/2010 Kawahara ..... G03G 9/0819 399/159
7,931,848 B2 * 4/2011 Ochi ..... C09D 5/28 264/331.11
8,457,528 B2 7/2013 Ochi et al.
8,783,209 B2 7/2014 Kaku et al.
9,114,565 B2 8/2015 Kawai et al.
9,389,521 B2 7/2016 Takahashi et al.
9,766,561 B2 9/2017 Takahashi et al.
9,772,596 B2 9/2017 Mitsui et al.
9,817,324 B2 9/2017 Kitamura et al.
9,971,258 B2 5/2018 Kitamura et al.
10,042,273 B2 8/2018 Takahashi et al.
2002/0037464 A1 * 3/2002 Kawada ..... G03G 5/043 430/66
2005/0113230 A1 * 5/2005 Hirasawa ..... C23C 4/02 492/53
2008/0096123 A1 * 4/2008 Shimada ..... G03G 5/047 430/127
2010/0062171 A1 * 3/2010 Kaku ..... B05C 3/09 427/430.1
2010/0172670 A1 * 7/2010 Ohshima ..... G03G 5/0525 399/111
2010/0329741 A1 * 12/2010 Nohsho ..... G03G 15/751 399/159
2011/0158683 A1 * 6/2011 Okuda ..... G03G 5/0564 399/111
2013/0221560 A1 * 8/2013 Kawai ..... B29C 59/021 264/104
2013/0270740 A1 * 10/2013 Nishida ..... G03G 5/00 264/293
2014/0093281 A1 4/2014 Takahashi et al.
2016/0349670 A1 * 12/2016 Kubo ..... G03G 15/0921
2017/0285497 A1 * 10/2017 Kitamura ..... G03G 21/1814
2017/0299971 A1 * 10/2017 Mori ..... G03G 5/071

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, a process cartridge, and an electrophotographic apparatus.

Description of the Related Art

Since an electrical or mechanical external force such as charging or cleaning is applied to a surface of a cylindrical electrophotographic photosensitive member (hereinafter, also simply referred to as an electrophotographic photosensitive member), durability (abrasion resistance or the like) against these external forces is required.

In response to this requirement, improved techniques, for example, a technique to use a resin (curable resin or the like) having high abrasion resistance in a surface layer of the electrophotographic photosensitive member and the like, have been used in the art.

Meanwhile, as a main problem occurring by enhancing abrasion resistance of the surface of the electrophotographic photosensitive member, there is an influence on cleaning performance performed by a cleaning blade. As main factors in an electrophotographic apparatus at the time of maintaining cleaning performance for a long period of time, shape maintainability of a tip of the cleaning blade and uniformization of stress applied to the cleaning blade can be mentioned. Since the tip of the cleaning blade comes in contact with the surface of the electrophotographic photosensitive member to scrape unnecessary toner, abrasion of the tip occurs as a developing process is repeated. As the friction force with the surface of the electrophotographic photosensitive member is decreased, the abrasion as described above is further suppressed. Further, in the case in which there is a deviation in an image pattern in an axial direction of the electrophotographic photosensitive member, a difference in stress applied to the cleaning blade in a longitudinal direction of the cleaning blade may be generated. Therefore, a method of reducing the frictional force by appropriately roughening the surface of an electrophotographic photosensitive member and reducing a contact area between the surface of the electrophotographic photosensitive member and the cleaning blade has been proposed.

For example, a method for controlling a fine shape to be transferred onto a surface of an electrophotographic photosensitive member with high accuracy has been disclosed in Japanese Patent No. 4059518. This method is excellent in view of diversity of a shape to be transferred and controllability. Further, this method is excellent in that stress applied to the cleaning blade is made uniform in a longitudinal direction.

Further, an electrophotographic photosensitive member in which a non-uniform shape is partially formed in a circumferential direction of the electrophotographic photosensitive member as a method of further reducing a friction force with a cleaning blade has been disclosed in Japanese Patent Application Laid-Open No. 2016-218318. The method disclosed in Japanese Patent Application Laid-Open No. 2016-218318 is excellent in view of reducing a friction force generated between a surface of the electrophotographic photosensitive member and the cleaning blade.

In the future, there is a need to further extend a lifespan of an electrophotographic apparatus, make stress applied to the cleaning blade uniform in the longitudinal direction, and reduce a friction force generated between the surface of the electrophotographic photosensitive member and the cleaning blade.

SUMMARY OF THE INVENTION

An object of the present invention is to provide an electrophotographic photosensitive member capable of extending a lifespan of a cleaning blade, a process cartridge, and an electrophotographic apparatus. Another object of the present invention is to provide a process cartridge and an electrophotographic apparatus having the electrophotographic photosensitive member as described above.

The object is achieved by the present invention. According to an exemplary embodiment of the present invention, there is provided a cylindrical electrophotographic photosensitive member including a plurality of concave portions on a surface thereof, wherein a sum of opening areas of the concave portions is 5% or more and 65% or less based on a total area of a surface layer of the electrophotographic photosensitive member, an average value davg of depths of the concave portions satisfies the following Equation (1), $$0.4 \leq davg \leq 3.0 (\mu m) \quad \text{Equation (1)}$$

a sum of opening areas of concave portions having a depth d satisfying the following Equation (2) is 95% or more of the sum of the opening areas of the concave portions, $$davg-0.2 \leq d \leq davg+0.2 (\mu m) \quad \text{Equation (2)}$$

an average value Lavg of maximum widths of openings of the concave portions in a circumferential direction of the electrophotographic photosensitive member is 20 μm or more and 200 μm or less, and the electrophotographic photosensitive member has at least one region B on the surface thereof, where (band Y0)

a band Y0 is, when an average value of maximum widths of the openings of the concave portions in an axial direction of the electrophotographic photosensitive member is defined as Wavg, an annular band including a line LY0 having a width of 4×Wavg, the line LY passing through the center of the electrophotographic photosensitive member in the axial direction as a central line and, (line X0)

a line X0 is, (i) when two or more shallow concave portions of which 50% or more of the opening area is included in the band Y0 and a depth is 0.5×davg or less are continuously present in the band Y0, a line in the axial direction of the electrophotographic photosensitive member, passing through a central point of a line segment and being orthogonal to the band Y0, the line segment connecting deepest positions of two concave portions positioned at both ends in the circumferential direction among the shallow concave portions that are continuously present, or (ii) when the shallow concave portion of which 50% or more of an opening area is included in the band Y0 and a depth is 0.5×davg or less is present alone in the band Y0, a line in the axial direction of the electrophotographic photosensitive member, passing through the deepest position of the shallow concave portion and being orthogonal to the band Y0, (region A)

a region A, on the surface of the electrophotographic photosensitive member, which is a tetragonal region of 200 μm square partitioned by lines in the circumferential direction which are formed in parallel to the line LY0 and arranged to have an interval of 200 μm therebetween, and lines in the axial direction which are formed in parallel to the line X0 in a region up to a position spaced apart from the line X0 by 35 mm and arranged to have an interval of 200 μm therebetween, is a tetragonal region in which a ratio of the number of shallow concave portions having a depth of 0.5×davg or less to the total number of concave portions of which 50% or more of the opening area is included in the tetragonal region is 25% or more, (region B)

a region B is an arc shaped region formed by an aggregate satisfying the following condition 1 among aggregates of the region A in which any one of four sides or four corners of the region A comes in contact with each other, and (condition 1)

a length of the aggregate in the axial direction of the electrophotographic photosensitive member is 90% or more based on a maximum length of a concave portion formation region in the axial direction of the electrophotographic photosensitive member, a length of the aggregate in the circumferential direction of the electrophotographic photosensitive member is 1% or more and 10% or less based on the maximum length of the concave portion formation region in the axial direction of the electrophotographic photosensitive member, and when quadratic function approximation is performed on a central point of each of the regions A constituting the aggregate by a least squares method in an orthogonal coordinate system in which the axial direction of the electrophotographic photosensitive member is the X direction and the circumferential direction thereof is the Y direction, a correlation coefficient R of an approximate curve is 0.5 or more.

According to another exemplary embodiment of the present invention, there is provided a process cartridge integrally supporting the electrophotographic photosensitive member described above and a cleaning unit having a cleaning blade disposed to come in contact with the electrophotographic photosensitive member, wherein the process cartridge is detachably attachable to a main body of the electrophotographic apparatus.

According to another exemplary embodiment of the present invention, there is provided an electrophotographic apparatus including the electrophotographic photosensitive member described above, a charging unit, an exposing unit, a developing unit, a transferring unit, and a cleaning unit having a cleaning blade disposed to come in contact with the electrophotographic photosensitive member.

Further features of the present invention will become apparent from the following description of exemplary embodiments with reference to the attached drawings.

DESCRIPTION OF THE EMBODIMENTS

Figure 1A:
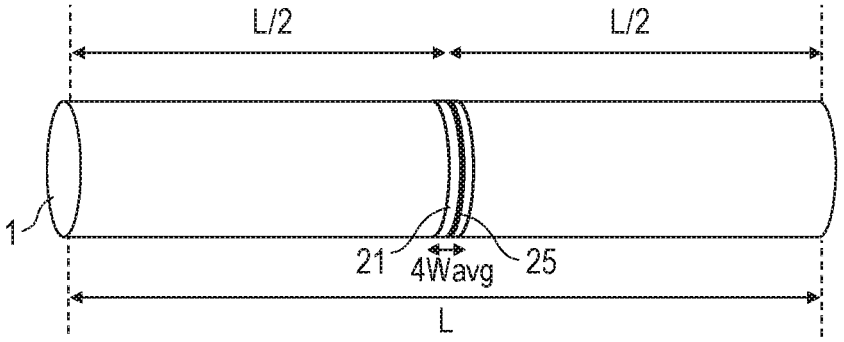
FIGS. 1A, 1B, 1C and 1D are views schematically illustrating reference lines for setting a region on a surface of an electrophotographic photosensitive member according to the present invention.

Preferred embodiments of the present invention will now be described in detail in accordance with the accompanying drawings.

An electrophotographic photosensitive member according to the present invention is a cylindrical electrophotographic photosensitive member including a plurality of concave portions on a surface thereof.

In the cylindrical electrophotographic photosensitive member including the plurality of concave portions on the surface thereof according to the present invention, a sum of opening areas of the concave portions is 5% or more and 65% or less based on a total area of a surface layer of the electrophotographic photosensitive member.

In addition, an average value davg of depths of the concave portions satisfies the following Equation (1).

$$0.4 \leq davg \leq 3.0 (\mu m) \quad \text{Equation (1)}$$

Further, in the electrophotographic photosensitive member including the plurality of concave portions on the surface thereof according to the present invention, a sum of opening areas of concave portions having a depth d satisfying the following Equation (2) is 95% or more of the sum of the opening areas of the concave portions.

$$davg-0.2 \leq d \leq davg+0.2 (\mu m) \quad \text{Equation (2)}$$

In the cylindrical electrophotographic photosensitive member including the plurality of concave portions on the surface thereof according to the present invention, an average value Lavg of maximum widths of openings of the concave portions in a circumferential direction of the electrophotographic photosensitive member is 20 μm or more and 200 μm or less.

Further, the electrophotographic photosensitive member including the plurality of concave portions on the surface thereof according to the present invention has at least one region B on the surface thereof.

(Region B)

The region B is an arc shaped region formed by an aggregate satisfying the following condition 1 among aggregates of the region A of which any one of four sides or four corners comes in contact with each other.

(Condition 1)

A length of the aggregate in an axial direction of the electrophotographic photosensitive member is 90% or more based on a maximum length of a concave portion formation region in the axial direction of the electrophotographic photosensitive member, a length of the aggregate in a circumferential direction of the electrophotographic photosensitive member is 1% or more and 10% or less based on the maximum length of the concave portion formation region in the axial direction of the electrophotographic photosensitive member, and when quadratic function approximation is performed on a central point of each of the regions A constituting the aggregate by a least squares method in an orthogonal coordinate system in which the axial direction of the electrophotographic photosensitive member is the X direction and the circumferential direction thereof is the Y direction, a correlation coefficient R of an approximate curve is 0.5 or more.

The region A is described with reference to FIGS. 1A to 1D. First, a [band Y0] and a [line X0] are defined as follows.

[Band Y0]

As illustrated in FIG. 1A, the band Y0 21 is an annular band including a line LY0 25 having a width of 4×Wavg, the line LY0 25 passing through the center of an electrophotographic photosensitive member 1 in the axial direction as a central line and when the average value of the maximum widths of the openings of the concave portions in the axial direction of the electrophotographic photosensitive member 1 is defined as Wavg.

[Line X0]

Figure 1B:
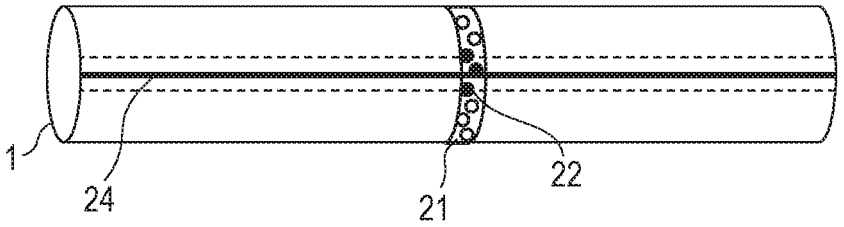

As illustrated in FIG. 1B, the line X0 24 is (i) a line in the axial direction of the electrophotographic photosensitive member 1, passing through a central point of a line segment and being orthogonal to the band Y0 21, the line segment connecting deepest positions of two concave portions 22 positioned at both ends in the circumferential direction among the shallow concave portions 22 that are continuously present when two or more shallow concave portions 22 of which 50% or more of an opening area is included in the band Y0 21 and a depth is 0.5×davg or less are continuously present in the band Y0 21, or (ii) a line in the axial direction of the electrophotographic photosensitive member 1, passing through the deepest position of the shallow concave portion 22 and being orthogonal to the band Y0 21 when the shallow concave portion 22 of which 50% or more of an opening area is included in the band Y0 21 and a depth is 0.5×davg or less is present alone in the band Y0 21.

Subsequently, [region A] and [region B] are described below.

[Region A]

Figure 1C:
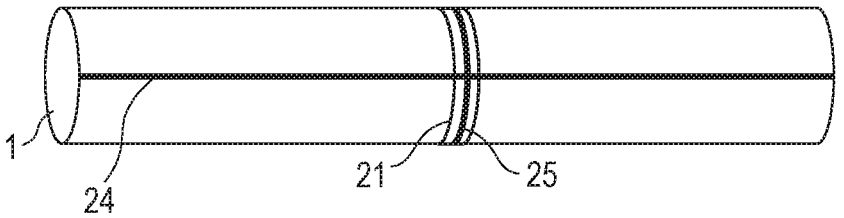
Figure 1D:
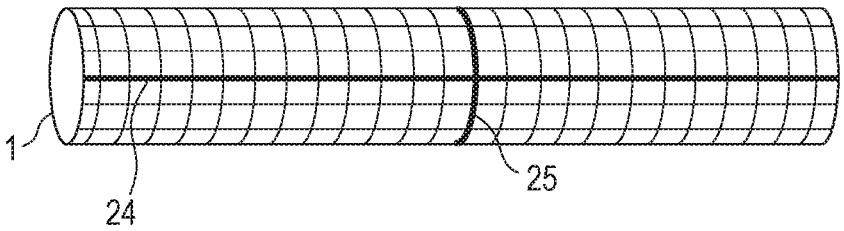

As illustrated in FIGS. 1C and 1D, the region A, which is a tetragonal region of 200 μm square partitioned by lines in the circumferential direction which are formed in parallel to the line LY0 25 and arranged to have an interval of 200 μm therebetween and lines in the axial direction which are formed in parallel to the line X0 24 in a region up to a position spaced apart from the line X0 24 by 35 mm and arranged to have an interval of 200 μm therebetween on the surface of the electrophotographic photosensitive member 1, is a tetragonal region in which a ratio of the number of shallow concave portions 22 having a depth of 0.5×davg or less to the total number of concave portions of which 50% or more of the opening area is included in the tetragonal region is 25% or more.

[Region B]

The region B is an arc shaped region formed by an aggregate satisfying the following condition 1 among aggregates of the region A in which any one of four sides or four corners of the region A comes in contact with each other.

(Condition 1)

A length of the aggregate in the axial direction of the electrophotographic photosensitive member is 90% or more based on a maximum length of a concave portion formation region in the axial direction of the electrophotographic photosensitive member, a length of the aggregate in the circumferential direction of the electrophotographic photosensitive member is 1% or more and 10% or less based on a maximum length of a concave portion formation region in the axial direction of the electrophotographic photosensitive member, and when quadratic function approximation is performed on a central point of each of the regions A constituting the aggregate by a least squares method in an orthogonal coordinate system in which the axial direction of the electrophotographic photosensitive member is the X direction and the circumferential direction thereof is the Y direction, a correlation coefficient R of an approximate curve is 0.5 or more.

In addition, the opening area of the concave portion means an area of a region enclosed by lines at which a recessed portion when the concave portion is viewed directly above from the surface of the electrophotographic photosensitive member comes in contact with flat portions around the recessed portion on the surface of the electrophotographic photosensitive member. Determination of the opening areas of these concave portions is described in detail later.

A main difference between the electrophotographic photosensitive member according to the present invention and an electrophotographic photosensitive member known in the art, having a surface on which concave portions are formed is described.

In view of further reducing a friction force with a cleaning blade, a feature of the surface of the electrophotographic photosensitive member known in the art is that a more uniform shape is stably formed over the entire surface. The phrase "more uniform shape" means that a depth of the concave portion is aligned with surrounding portions. Further, the phrase "stably formed over the entire surface" means that there is no specific portion in which the depth of the concave portion is insufficient as compared with the surrounding portions, particularly in a range in which the surface of the electrophotographic photosensitive member comes in contact with the cleaning blade.

Further, an electrophotographic photosensitive member in which a non-uniform portion is formed in a part of the electrophotographic photosensitive member in a circumferential direction is disclosed. The term "non-uniform portion" means that in the electrophotographic photosensitive member having the surface on which a concave portion is formed, a depth of the concave portion formed in a certain section is shallower than a depth of a concave portion formed in a section therearound.

Meanwhile, a main feature (configuration) of the electrophotographic photosensitive member according to the present invention is that a concave portion having a shallower depth than that of surrounding concave portions is continuously formed (in the region B). Further, the region B is curved in a quadratic curve shape in an orthogonal coordinate system in which the axial direction of the electrophotographic photosensitive member is an X direction and the circumferential direction of the electrophotographic photosensitive member is a Y direction (second feature).

In addition, the electrophotographic photosensitive member according to the present invention has a feature that depths of the concave portions are the same as each other in regions in which the other concave portions are formed other than regions in which the above-mentioned concave portion having a shallower depth than that of surrounding concave portions is continuously formed (first feature).

Next, functions of the electrophotographic photosensitive member having the region B in which the concave portion having a shallower depth than that of surrounding concave portions is continuously formed are described.

On the surface of the an electrophotographic photosensitive member known in the art, having a surface on which concave portions are formed, concave portions having a uniform depth are stably formed over the entire surface. The concave portion may reduce friction with the cleaning blade, but as a cleaning operation by a contact of the cleaning blade accompanied with a predetermined friction force is repeated, stress by the friction is slowly and continuously accumulated in the cleaning blade. Since the concave portions having a uniform depth is continuous formed, the stress is stably accumulated. As the stress is accumulated in the cleaning blade, the cleaning blade is temporarily in a state in which the cleaning blade loses flexibility, and thus, a friction force generated between the cleaning blade and the electrophotographic photosensitive member is further increased. In addition, abrasion started from a tip of the cleaning blade when the stress reaches a predetermined accumulation amount, and a shape of the tip of the cleaning blade is deformed by abrasion, such that a cleaning state is changed. Further, finally, the abrasion or change in the cleaning state proceeds, such that the cleaning blade reaches the end of its lifespan.

On the contrary, in the electrophotographic photosensitive member according to the present invention, concave portions having a uniform depth deeper than that of shallow concave portions are formed in other regions except for some regions in the circumferential direction in which the concave portions having a shallower depth than that of surrounding concave portions are formed. When a cleaning blade comes in contact with the surface of the electrophotographic photosensitive member to perform the cleaning, first, stress by friction is accumulated in a surface in which the concave portion having the uniform depth is continuously formed, similarly to the electrophotographic photosensitive member known in the art. Continuously, the cleaning blade comes in contact with the concave portion having a shallower depth than the surrounding concave portions and formed in some region in the circumferential direction, which is intermittently encountered by the rotation of the electrophotographic photosensitive member. Here, a strong friction force at a certain level or more is generated as compared with the case in which the cleaning blade comes in contact with the concave portion having a sufficient depth and continuously formed that was in contact until then. This change in a friction force can partially release the stress accumulated in the cleaning blade and can relieve stress accumulation. Therefore, deformation of the tip of the cleaning blade by abrasion can be suppressed, thereby making it possible to maintain the cleaning blade in a satisfactory state for a longer time.

Further, in the present invention, a region in which the concave portion having a depth shallower than that of surrounding concave portions is continuously formed such as the region B is curved substantially in a quadratic curve shape. In this way, it is possible to obtain an effect of suppressing a variation in stress applied to the cleaning blade in the longitudinal direction for two reasons.

The first reason is that in the present invention, in the region B, the concave portion having a depth shallower than that of the surrounding concave portions is provided without interruption in the axial direction of the electrophotographic photosensitive member. As a result, non-uniformity in stress applied to the cleaning blade is less likely to occur as compared to the case in which shallow concave portions are scattered. Particularly, it is easy to obtain the effect in the case in which there is a deviation in image pattern in the axial direction of the electrophotographic photosensitive member.

The second reason is that as the region B is curved in the quadratic curve shape, the concave portion having a depth shallower than that of the surrounding concave portions is continuously disposed while being slightly deviated in the circumferential direction of the electrophotographic photosensitive member. The deviation is large at both ends of the electrophotographic photosensitive member and small at the central portion thereof in the axial direction. That is, a range in which a contact nip of the cleaning blade and the region B overlap each other is narrow in the vicinity of both end portions of the electrophotographic photosensitive member and is wide in the vicinity of the central portion thereof in the axial direction.

Stress to the cleaning blade tends to increase in both end portions of the electrophotographic photosensitive member in the axial direction. For this reason, in this range, a contact area between the region B and the cleaning blade is reduced, and in the central portion of the electrophotographic photosensitive member in the axial direction, the contact area between the region B and the cleaning blade is increased. As a result, a variation in stress applied to the cleaning blade in the longitudinal direction is suppressed.

Figure 2:
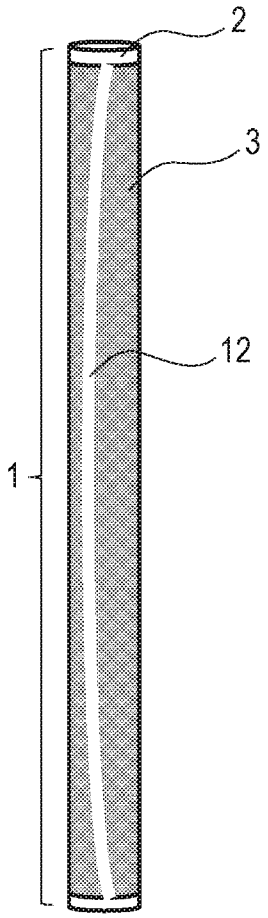
FIG. 2 is a view illustrating an example of an exterior of the electrophotographic photosensitive member according to the present invention.

The electrophotographic photosensitive member according to the present invention is described in more detail with reference to the accompanying drawings. FIG. 2 is a view illustrating an example of an exterior of the electrophotographic photosensitive member according to the present invention, and as illustrated in FIG. 2, a cylindrical electrophotographic photosensitive member 1 has a cylindrical substrate 2 and a surface layer 3 formed on a surface of the cylindrical substrate 2. In addition, a plurality of concave portions are formed on a surface of the surface layer 3. The concave portion may be formed in the same range as that of the surface layer 3 in the axial direction of the electrophotographic photosensitive member 1, and the concave portion may also be formed to be shorter than the range of the surface layer 3 as long as the concave portion is substantially formed in a range corresponding to a contact length of the cleaning blade.

Further, in the present invention, a sum of opening areas of the concave portions on the surface of the electrophotographic photosensitive member 1 is 5% or more and 65% or less, and particularly preferably 5% or more and 60% or less, based on a total area of the surface layer of the electrophotographic photosensitive member 1. An effect of reducing a friction force between the cleaning blade and the electrophotographic photosensitive member 1 is further enhanced by setting an area ratio (%) of the concave portions on the surface of the electrophotographic photosensitive member (the sum of the opening areas of the concave portions on the surface of the electrophotographic photosensitive member/ the total area of the surface layer of the electrophotographic photosensitive member) to be 5% or more as described above. Meanwhile, by setting the area ratio of the concave portions to 65% or less, a flat portion on the surface of the electrophotographic photosensitive member 1 can be sufficiently maintained, and it is possible to effectively suppress slipping of a toner at the time of cleaning. In addition, by setting the area ratio to 60% or less, the flat portion can be more sufficiently maintained, and it is possible to more effectively suppress the slipping of the toner at the time of cleaning.

Next, the depth of the concave portion is described. As described above, the electrophotographic photosensitive member according to the present invention has the first feature that the concave portions having the uniform depth are formed in most of the surface (more specifically, the other portions except for a region A to be described below). Further, the electrophotographic photosensitive member has the second feature that the concave portion having a depth shallower than that of the surrounding concave portions is continuously formed (region B) and the region B is curved approximately in a quadratic curve shape in the orthogonal coordinate system in which the axial direction of the electrophotographic photosensitive member is the X direction and the circumferential direction of the electrophotographic photosensitive member is the Y direction.

First, the first feature that the concave portions having the uniform depth are formed in most of the surface is described. It is important that the concave portion formed on the surface of the electrophotographic photosensitive member 1 satisfies the following two requirements.

The first requirement is that the average value davg of the depths of the concave portions satisfies Equation (1), that is, the average value davg is in a range of 0.4 μm or more and 3.0 μm or less. When the average value davg is 0.4 μm or more, the effect of reducing friction between the cleaning blade and the electrophotographic photosensitive member 1 may be improved. Further, when average value davg is 3.0 μm or less, it is possible to more effectively suppress occurrence of the slipping of the toner at the time of cleaning.

The second requirement is that the concave portions having a uniform depth occupy 95% or more of the concave portions formed on the surface of the electrophotographic photosensitive member 1. More specifically, a sum of opening areas of the concave portions having a uniform depth occupies 95% of the sum of the opening areas of the concave portions formed on the surface of the electrophotographic photosensitive member 1. Further, the concave portions having a uniform depth means concave portions having a depth d in a range in which a difference from the average value davg of the depths of the concave portions is −0.2 μm or more and +0.2 μm or less, that is, a depth d satisfying Equation (2). When a variation in depth of the concave portion is within this range, the friction between the cleaning blade and the surface of the electrophotographic photosensitive member 1 is stabilized, and the stress newly added to the cleaning blade to thereby be accumulated therein can be suppressed to be low. The concave portions having a uniform depth occupy 95% or more of the concave portions as described above, such that a basic friction force between the cleaning blade and the surface of the electrophotographic photosensitive member 1 can be maintained to be low.

Further, the first feature has a function of making a difference in a friction state with a non-uniform concave portion described below become apparent in addition to maintaining the basic friction force to be low and preventing slipping of the toner.

Next, the second feature is described. On the surface of the electrophotographic photosensitive member 1 according to the present invention, it is necessary that at least one region B is formed as a second feature in addition to the first feature.

The region B is an aggregate of regions A. First, a procedure of determining the region A is described.

First, an average value Wavg of maximum widths of openings of the concave portions on the surface of the electrophotographic photosensitive member 1 in the axial direction of the electrophotographic photosensitive member is obtained.

Next, when the average value of the maximum widths of the openings of the concave portions in the axial direction of the electrophotographic photosensitive member 1 is Wavg, an annular band Y0 including a line LY0 25 and having a width of 4×Wavg, the line LY0 25 passing through the center of the electrophotographic photosensitive member in the axial direction as a central line is set.

(i) A line X0 corresponding to a line in the axial direction of the electrophotographic photosensitive member 1, passing through a central point of a line segment and being orthogonal to the band Y0, the line segment connecting deepest positions of two concave portions positioned at both ends in the circumferential direction among the shallow concave portions that are continuously present when two or more shallow concave portions of which 50% or more of an opening area is included in the band Y0 and a depth is 0.5×davg or less are continuously present in the band Y0, or (ii) a line in the axial direction of the electrophotographic photosensitive member 1, passing through the deepest position of a shallow concave portion and being orthogonal to the band Y0 when the shallow concave portion of which 50% or more of an opening area is included in the band Y0 and a depth is 0.5×davg or less is present alone in the band Y0 is set.

On the surface of the electrophotographic photosensitive member 1, as the tetragonal region of 200 μm square partitioned by lines in the circumferential direction which are formed in parallel to the line LY0 25 and arranged to have an interval of 200 μm therebetween and lines in the axial direction which are formed in parallel to the line X0 in a region up to a position spaced apart from the line X0 by 35 mm and arranged to have an interval of 200 μm therebetween, a tetragonal region in which a ratio of the number of shallow concave portions having a depth of 0.5×davg or less to the total number of concave portions of which 50% or more of the opening area is included in the tetragonal region is 25% or more is defined as the region A.

Among aggregates of the region A in which any one of four sides or four corners of the region A comes in contact with each other, an arc shaped region formed by an aggregate satisfying the following condition 1 is defined as the region B.

(Condition 1)

A length of the aggregate in the axial direction of the electrophotographic photosensitive member is 90% or more based on a maximum length of a concave portion formation region in the axial direction of the electrophotographic photosensitive member, a length of the aggregate in the circumferential direction of the electrophotographic photosensitive member is 1% or more and 10% or less based on a maximum length of a concave portion formation region in the axial direction of the electrophotographic photosensitive member, and when quadratic function approximation is performed on a central point of each of the regions A constituting the aggregate by a least squares method in the orthogonal coordinate system in which the axial direction of the electrophotographic photosensitive member is the X direction and the circumferential direction thereof is the Y direction, a correlation coefficient R of an approximate curve is 0.5 or more.

Next, conditions to be satisfied by the region B in order to obtain the effect of the present invention will be described.

The condition 1 is preferably any one of the following conditions 1A to 1C.

<Condition 1A>

When the approximate curve is drawn by performing quadratic function approximation on the central point of each of the regions A constituting the region B by a least squares method in the orthogonal coordinate system in which the axial direction of the electrophotographic photosensitive member is the X direction and the circumferential direction thereof is the Y direction, a correlation coefficient R is 0.7 or more, and a length of the region B in the Y direction in the orthogonal coordinate system is 3% or more and 7% or less of a maximum length of the concave portion formation region in the axial direction.

<Condition 1B>

When the approximate curve is drawn by performing quadratic function approximation on the central point of each of the regions A constituting the region B by a least squares method in the orthogonal coordinate system in which the axial direction of the electrophotographic photosensitive member is the X direction and the circumferential direction thereof is the Y direction, a correlation coefficient R is 0.7 or more, and a length of the region B in the Y direction in the orthogonal coordinate system is 1% or more and 10% or less of a maximum length of the concave portion formation region in the axial direction.

<Condition 1C>

When the approximate curve is drawn by performing quadratic function approximation on the central point of each of the regions A constituting the region B by a least squares method in the orthogonal coordinate system in which the axial direction of the electrophotographic photosensitive member is the X direction and the circumferential direction thereof is the Y direction, a correlation coefficient R is 0.5 or more, and a length of the region B in the Y direction in the orthogonal coordinate system is 1% or more and 10% or less of a maximum length of the concave portion formation region in the axial direction.

The condition 1 specifies a shape of the region B. As described above, in the case in which the region B has a shape close to a quadratic curve, variation in stress in the longitudinal direction applied to the cleaning blade is suppressed. In order to determine whether or not the shape of the region B is ideal, the approximate curve obtained by performing quadratic function approximation on the central point of the region A constituting the region B using the least squares method is evaluated. When the correlation coefficient R obtained from the obtained approximate curve is 0.5 or more, the region B is a quadratic curve shape, and it is easy to obtain the effect of the present invention.

Further, the length of the region B in the Y direction in the orthogonal coordinate system indicates a degree of curvature of the region B. When the length of the region B in the Y direction in the orthogonal coordinate system is 1% or more of the maximum length of the concave portion formation region in the axial direction, the region B is sufficiently curved, such that it is easy to obtain the effect of suppressing a variation in stress applied to the cleaning blade in the longitudinal direction.

When the length of the region B in the Y direction in the orthogonal coordinate system is 10% or less of the maximum length of the concave portion formation region in the axial direction, a contact time between the region B and the cleaning blade is shortened, such that stress accumulated in the cleaning blade is partially released, whereby it is easy to obtain an effect of relieving accumulation of stress.

Further, the closer the shape of the region B is to a symmetrical shape with respect to the band Y0, the more difficult it is for a behavior of the cleaning blade to be deviated in the longitudinal direction when the cleaning blade comes into contact with the electrophotographic photosensitive member, which is preferable.

Hereinafter, determination (definition) or the like of the concave portion and the flat portion on the surface of the cylindrical electrophotographic photosensitive member according to the present invention is described.

Figure 3:
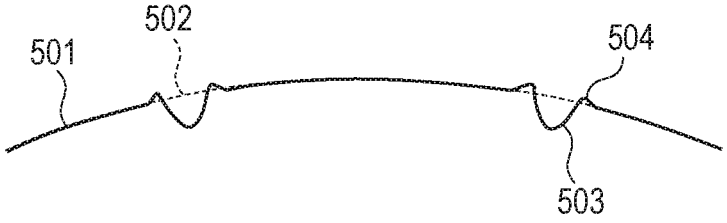
FIG. 3 is a view illustrating an example of fitting of concave portions of a surface of the electrophotographic photosensitive member according to the present invention.

First, the surface of the cylindrical electrophotographic photosensitive member is enlarged and observed using a laser microscope capable of obtaining information also in a depth direction. Since the surface (circumferential surface) of the electrophotographic photosensitive member is a curved surface bent in the circumferential direction, a cross-sectional profile of the curved surface is extracted using image processing software and an arc is fitted to the obtained cross-sectional profile of the curved surface. An example of the fitting is illustrated in FIG. 3. In FIG. 3, a solid line 501 is the cross-sectional profile of the surface (curved surface) of the electrophotographic photosensitive member, and a broken line 502 is a curve fitted to the cross-sectional profile 501. The cross-sectional profile 501 microscopically has a concave shape 503 and a convex shape 504 adjacent to the concave shape 503 that can be formed at the time of forming the concave shape 503, and portions of the concave shape 503 and the convex shape 504 generate a deviation from the curve 502 obtained by the fitting. Subsequently, the cross-sectional profile 501 is corrected so that the curve 502 becomes a straight line. That is, the cross-sectional profile 501 is corrected so that a circular arc shape as a whole becomes a straight line. Here, correction is not applied to a shape of portions in which the deviation occurs between the curve 502 and the cross-sectional profile 501, more specifically, shapes of the cross-sectional profiles of the concave shape 503 and the convex shape 504 adjacent to the concave shape 503. That is, the concave shape 503 and the convex shape 504 adjacent to the concave shape 503 are not changed. A plane obtained by expanding the straight line obtained by fitting the cross-sectional profile after correction in the longitudinal direction (direction orthogonal to the circumferential direction) of the electrophotographic photosensitive member is defined as a reference plane.

A plane positioned to be deviated from the obtained reference plane by 0.2 μm in a central direction (below the reference plane) of a cross section of the electrophotographic photosensitive member and is parallel with the reference plane is defined as a second reference plane. A portion positioned in a direction away from the central direction of the cross section of the electrophotographic photosensitive member as compared to the second reference plane (above the second reference plane) is defined as a flat portion. In description of the concave portion formed on the surface of the electrophotographic photosensitive member, a portion positioned in a cylindrical central direction of the cross section of the electrophotographic photosensitive member (below the second reference plane) as compared to the second reference plane is defined as the concave portion. A distance from the second reference plane to a point of the concave portion farthest in the central direction of the cross section of the electrophotographic photosensitive member is defined as a depth of the concave portion. A portion surrounded by a line at which the second reference plane and the concave portion meet each other is defined as an opening of the concave portion, and an area of the opening is defined as an opening area of the concave portion. The line surrounding the opening is a line at which a recessed portion comes in contact with surrounding flat portions when the concave portion is viewed from directly above the surface of the electrophotographic photosensitive member.

Figure 4:
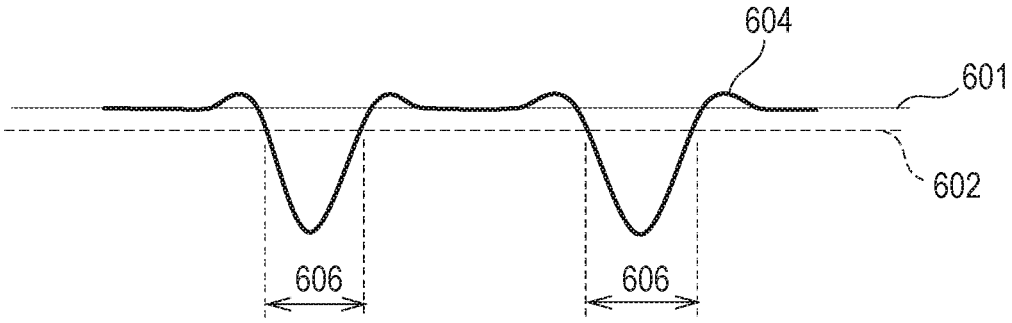
FIG. 4 is a view schematically illustrating relationships of a reference plane, a flat surface, concave portions and the like according to the present invention.

FIG. 4 schematically shows relationships between the reference plane 601, the flat portion (above the second reference plane 602), the cross-sectional profile 604 after correction, the concave portion 606 and the like as a determination example of the concave portion.

Figure 5A:
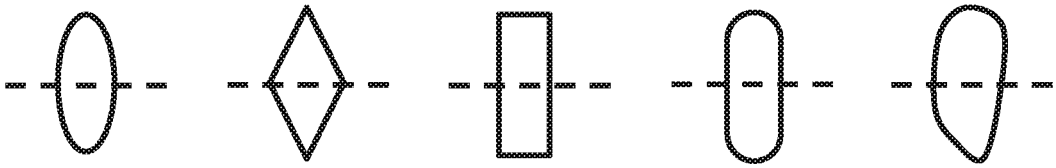
FIG. 5A is a view illustrating an example of a shape of an opening of the concave portion of the surface of the electrophotographic photosensitive member according to the present invention.
Figure 5B:
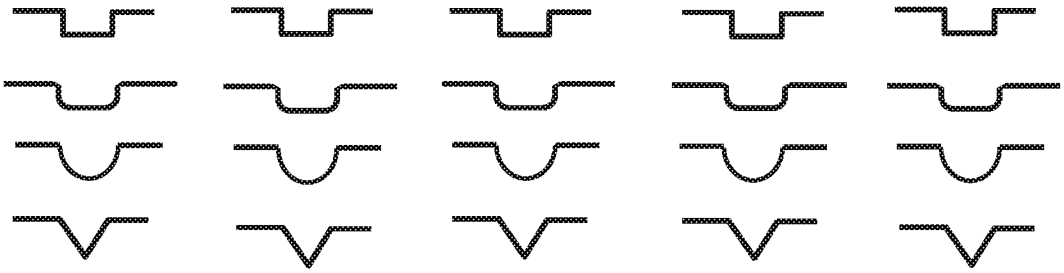
FIG. 5B is a view illustrating an example of a cross-sectional shape of the concave portion of the surface of the electrophotographic photosensitive member according to the present invention.

A shape of the concave portion formed on the surface of the electrophotographic photosensitive member is not particularly limited. Examples of the shape of the concave portion are illustrated in FIG. 5A. Examples of a shape of the opening of the concave portion may include a circle, an oval, a square, a rectangle, a triangle, a pentagon, a hexagon, and the like. Further, examples of a cross-sectional shape of the concave portion are illustrated in FIG. 5B. Examples of the cross-sectional shape of the concave portion may include a shape having a curve such as a substantially semicircle shape, a wave shape having a continuous curve, shapes having a triangular edge, a tetragonal edge and a polygonal edge, a shape in which a triangular, tetragonal, or polygonal edge is partially or entirely deformed into a curve, and the like. The plurality of concave portions formed on the surface of the electrophotographic photosensitive member may have different shapes, different opening areas, or different depths from each other and be mixed with each other.

As a method of forming the concave portion on the surface of the electrophotographic photosensitive member, a method of press-contacting a mold member having a convex portion corresponding to a concave portion to be formed with the surface of the electrophotographic photosensitive member to transfer the shape may be exemplified.

Figure 6A:
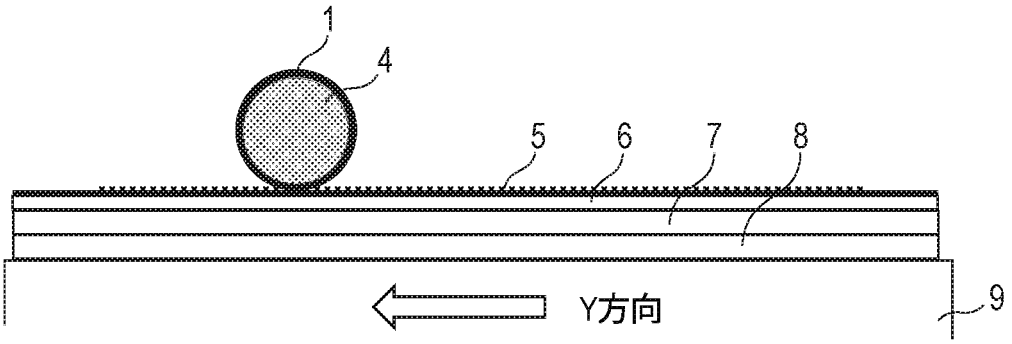
FIGS. 6A and 6B are views illustrating an example of a method of forming the concave portion on the surface of the electrophotographic photosensitive member according to the present invention.
Figure 6B:
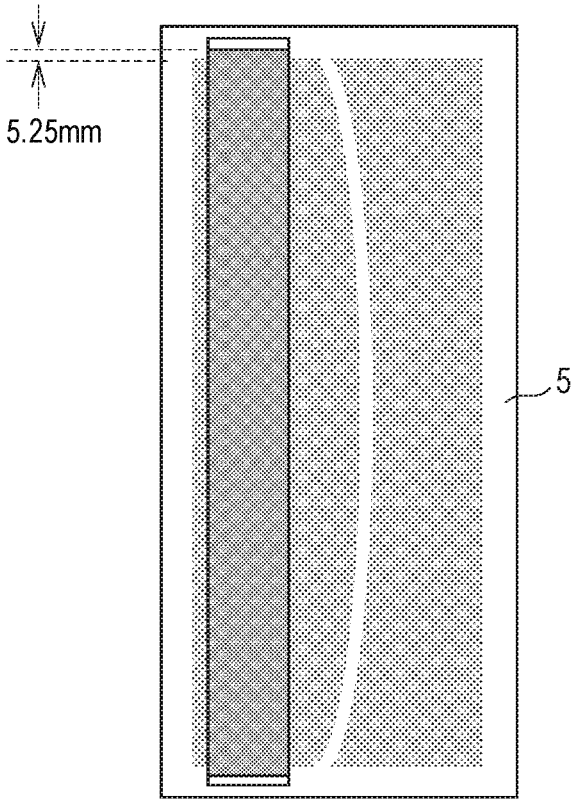
Figure 7C:
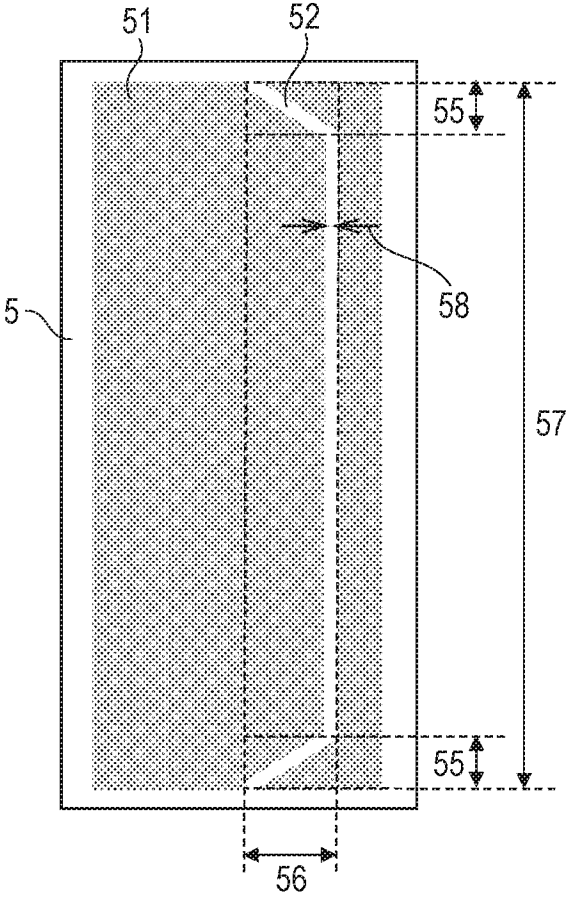
FIGS. 7A, 7B and 7C are views illustrating an example of a mold member for forming a concave portion or a convex-shaped portion on the surface of the electrophotographic photosensitive member according to the present invention.
Figure 7B:
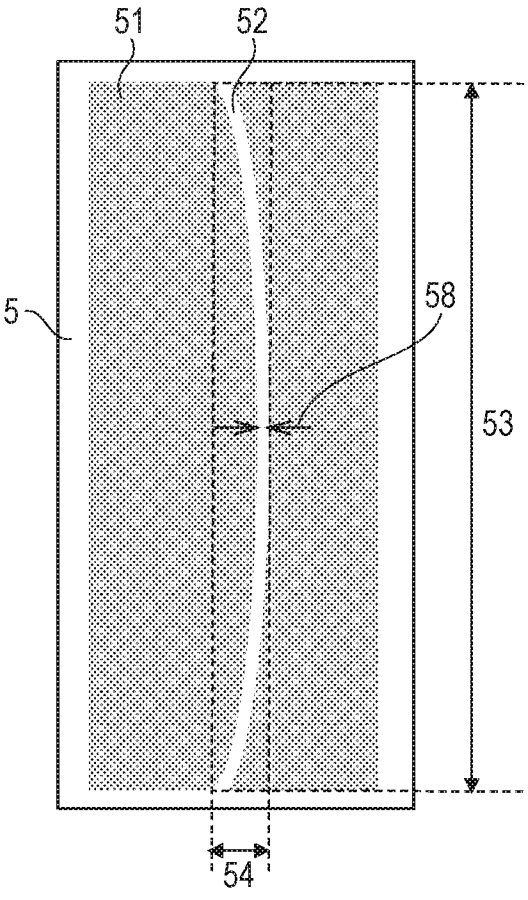
Figure 7A:
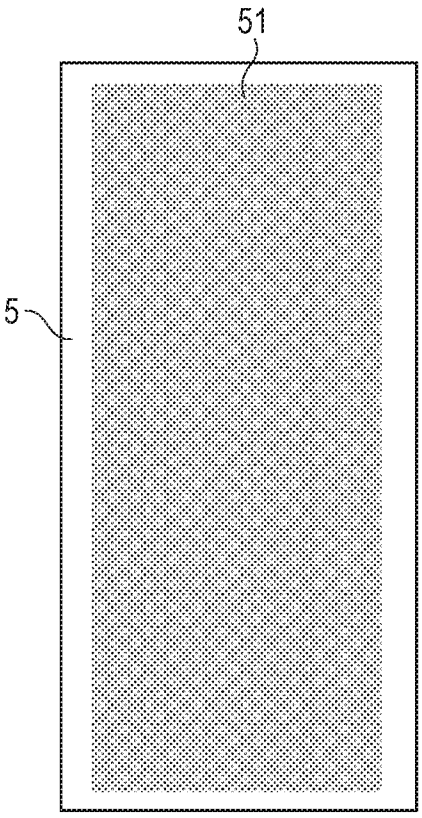

FIGS. 6A and 6B illustrate an example of a press-contact shape transfer working device for forming the concave portion on the surface of an electrophotographic photosensitive member. FIG. 6A is a side view illustrating the press-contact shape transfer working device, and FIG. 6B is a top view illustrating the press-contact shape transfer working device. Further, FIGS. 7A to 7C illustrate examples of the mold member for forming the concave portion on the surface of the electrophotographic photosensitive member. FIGS. 7A to 7C are top views schematically illustrating the mold member for forming the concave portion.

In the press-contact shape transfer working device of FIGS. 6A and 6B, in order from the closest to the electrophotographic photosensitive member 1 which is a transfer object, a mold member 5, a metal layer 6, an elastic layer 7, and a positioning member 8 are sequentially disposed on a support member 9. After an insertion member 4 is inserted into the electrophotographic photosensitive member 1 using the press-contact shape transfer working device as described above, a load is applied to the insertion member 4, and at the same time, the mold member 5 is moved in a Y direction illustrated in FIG. 6A using a slide tool or the like. In this way, the concave portion may be formed on the surface of the electrophotographic photosensitive member 1 by continuously press-contacting the mold member 5 with the surface (outer peripheral surface) of the electrophotographic photosensitive member 1 while rotating the electrophotographic photosensitive member 1. In view of efficiently performing the shape transfer, it is preferable to heat the mold member 5 or the electrophotographic photosensitive member 1.

FIGS. 7A to 7C illustrates the mold member 5 in which a convex-shaped portion for forming the concave portion on the surface of the electrophotographic photosensitive member is formed on a flat plate. The mold member 5 of FIG. 7A has a first convex-shaped part 51 in which a plurality of convex-shaped portions are formed over an entire surface at a predetermined pitch. The mold member 5 of FIGS. 7B and 7C has a first convex-shaped part 51 in which a plurality of convex-shaped portions are formed at a predetermined pitch. Further, the mold member 5 of FIGS. 7B and 7C also has a second convex-shaped part 52 in which a plurality of convex-shaped portions for forming a shallow concave portion satisfying the predetermined conditions are formed over an entire surface at a predetermined pitch. A plurality of convex-shaped portion having a height lower than that of the convex-shaped portion formed in the first convex-shaped part 51 are formed in the second convex-shaped part 52.

Figure 8A:
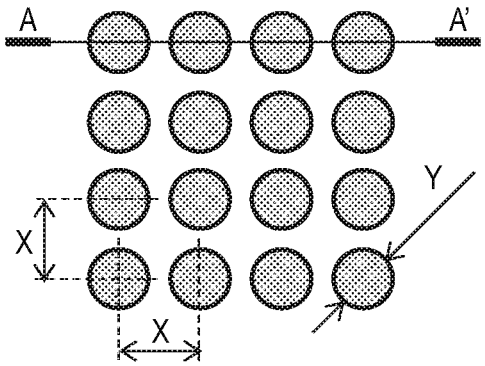
FIGS. 8A and 8B are views illustrating an example of a mold member according to the present invention.
Figure 8B:
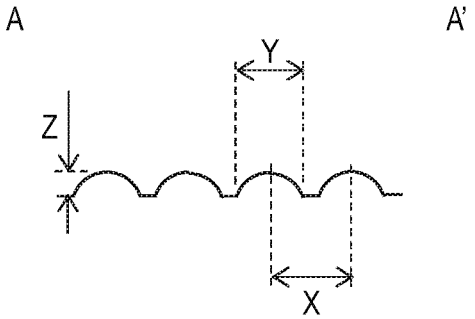

FIGS. 8A and 8B schematically illustrate the convex-shaped portion formed in the first or second convex-shaped part 51 or 52 of FIGS. 7A to 7C. FIG. 8A is a top view, and FIG. 8B is a cross-sectional view taken along line A-A' of FIG. 8A. A bottom surface of the convex-shaped portion formed in the first or second convex-shaped part 51 or 52, observed from above can have various shapes. Examples of a shape of the bottom surface can include a circle, an oval, a polygon such as a triangle, a tetragon, a hexagon and the like, shapes obtained by combining a curve with a portion or the whole of edges or sides of a polygon, and the like. Further, a cross-sectional shape of the convex-shaped portion may also be various shapes, for example, a shape having edges such as a triangle, a tetragon, a polygon and the like, a wave shape composed of a continuous curve, shapes obtained by combining a curve with a portion or the whole of edges of the triangle, the tetragon, or the polygon, and the like.

As the mold member 5, a finely surface-treated metal or resin film, a silicon wafer having a surface patterned with a resist, a resin film in which fine particles are dispersed, or a resin film having a fine surface shape on which a metal coating is performed can be mentioned.

The electrophotographic photosensitive member 1 according to the present invention in which the specific concave portion is formed can be manufactured by continuously press-contacting the mold member 5 of FIGS. 7B and 7C with the electrophotographic photosensitive member 1 at a uniform pressure. Further, in the case of using the mold member of FIGS. 7B and 7C, a concave portion shallower than the surroundings is formed by the second convex-shaped part 52. Further, the electrophotographic photosensitive member according to the present invention can be manufactured using the mold member having only the first convex-shaped part 51 illustrated in FIG. 7A in which convex-shaped portions having the same height are formed. More specifically, the electrophotographic photosensitive member according to the present invention in which the specific concave portion is formed can be manufactured by a method of adjusting a load or movement speed at the time of separating the electrophotographic photosensitive member 1 and the mold member 5 from each other. As the method of adjusting a load, for example, at the time of forming a shape, an operation of separating the electrophotographic photosensitive member 1 from the mold member 5 can be initiated before the movement of the mold member is stopped.

As a method of forming concave and convex shapes on the surface of the electrophotographic photosensitive member, particularly, as a method for mass-production, the following method can be used. That is, a method of press-contacting the electrophotographic photosensitive member on a surface of a mold member to form a shape using a mold unit including a mold member having a convex shape on a surface thereof, a metal member, and an elastic member can be used. In this method, the concavo-convex shape of the mold member is transferred to the surface of the electrophotographic photosensitive member by moving at least one of the electrophotographic photosensitive member and the mold member while pressing the electrophotographic photosensitive member against the mold member. Here, the elastic member is deformed by a pressing force from the electrophotographic photosensitive member. Since this deformation occurs sequentially from an upstream toward a downstream in a shape transfer direction in accordance with the movement of the mold member or the electrophotographic photosensitive member, the elastic member receives a force in the downstream direction of shape transfer and is slightly moved.

Each member constituting the mold unit may be fixed and used by a method such as screw fastening, or the like, thereby corresponding to mass-production. However, it is difficult to completely fix the elastic member, it is necessary to consider slight movement of the elastic member from the upstream direction of processing to the downstream direction in accordance with the shape transfer as described above. Correspondingly, in order to minimize the movement of the elastic member, it is preferable to form an abutting member on the downstream side in the shape transfer direction, but as long as processing is continued even after the elastic member comes in contact with the abutting member, movement of the elastic member is not stopped. Eventually, a density of the elastic member in the vicinity of the abutting member is increased, such that it is difficult to obtain an effect as the elastic member.

In order to solve this problem, it is effective to intermittently contact the elastic member and the abutting member with each other in a direction orthogonal to the shape transfer direction. In this way, it is possible to alleviate compression occurring between the elastic member and the abutting member due to the pressing force, thereby making it possible to suppress an increase in elastic modulus of the elastic member.

Further, as another method for solving the above-mentioned problem, a method of lowering an elastic modulus of a surface of the mold unit in the vicinity of the abutting member is effective. By lowering the elastic modulus of the surface of the mold unit in the vicinity of the abutting member, it is possible to alleviate compression occurring between the elastic member and the abutting member when the electrophotographic photosensitive member is pressed against the surface of the mold unit. As a method of lowering elastic modulus of the surface of the mold unit, it is preferable to use an elastic material having a low elastic modulus.

Further, in mass production, another method of alleviating compression between an elastic layer and the abutting member by repeated slight movement of the elastic layer from the upstream direction of the processing toward the downstream direction in accordance with the shape transfer will be described. That is, this method is a method of increasing slidability between the elastic layer and a member in contact with the elastic layer to promote the movement from the downstream direction of the processing to the upstream direction of the processing using a reaction force from the abutting member and to maintain the elastic modulus of the elastic layer to be constant.

Figure 12A:
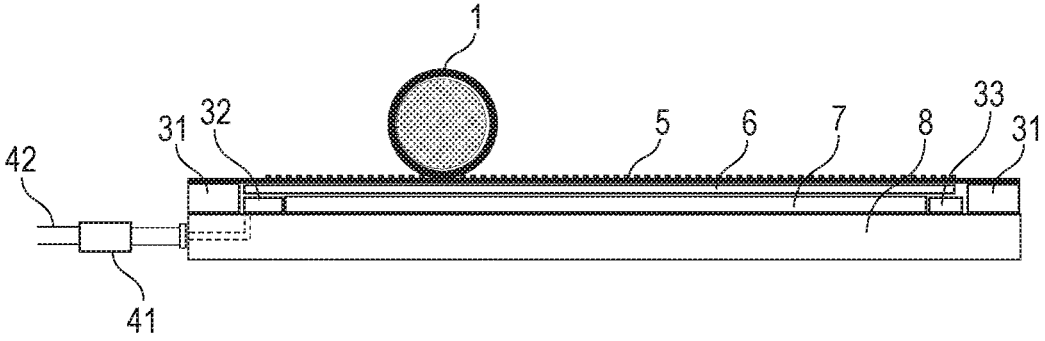
FIGS. 12A, 12B and 12C are views illustrating another example of the mold member according to the present invention.
Figure 12B:
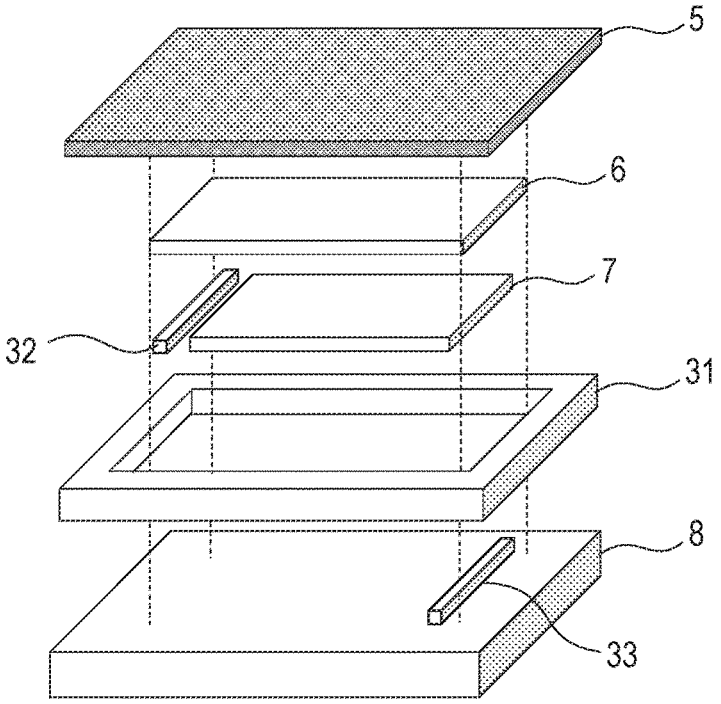
Figure 12C:
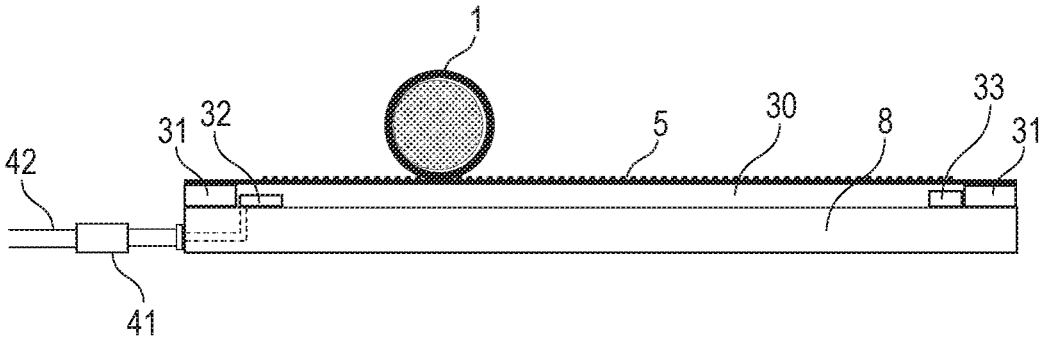

To this end, a mold unit as illustrated in FIGS. 12A to 12C is used. The mold member 5 and the positioning member 8 come in indirect contact with each other via an annular member 31 to form a depressurizable space 30. A member A32 is a member that volatilizes a lubricant ingredient under a reduced pressure environment and is disposed in the depressurizable space. The lubricant ingredient may be a liquid, but is preferably lubricating oil, and more preferably silicone based lubricating oil. As the member A32, for example, a silicone resin or the like prepared by lowering a secondary vulcanization temperature and increasing an amount of remaining low-molecular siloxane is preferable. An elastic layer 7 is disposed in the annular member 31 to come in contact with the mold member 5 and the positioning member 8. In order to describe the depressurizable space 30, a mold unit in which the metal layer 6 and the elastic layer 7 are omitted is illustrated in FIG. 12C. Further, the depressurizable space 30 is depressurized from the suction port 42 using a suction pump (not shown) to set a negative pressure with respect to the atmospheric pressure. The depressurized state at this time is expressed as degree of vacuum depending on the value displayed on the differential pressure gauge 41. Here, the lubricant ingredient volatilizes from the member A32 and adheres to a surface of each of the members in the mold unit. Therefore, it is possible to enhance slidability between the elastic layer 7 and the member coming in contact with the elastic layer.

Further, as a technology for forming the concavo-convex shape on the surface of the electrophotographic photosensitive member, as described above, conditions such as a temperature of the electrophotographic photosensitive member or the mold member, a pressure for pressing the electrophotographic photosensitive member against the mold member are important. Among them, the temperature of the electrophotographic photosensitive member or the mold member is particularly important in that the temperature has a large influence on controlling a depth of the concavo-convex shape formed on the surface of the electrophotographic photosensitive member. In addition, since the surface of the electrophotographic photosensitive member is a resin film, the temperature of the electrophotographic photosensitive member can be measured using a radiation thermometer or the like. On the other hand, since the mold member is required to have a certain strength and durability, it is preferable that the mold member is made of a metal material containing iron, stainless steel, nickel or the like, as a main ingredient, and these materials have low surface emissivity, such that It is difficult to use the radiation thermometer described above. Further, although it is possible to accurately measure the temperature by using a contact-type measuring element such as a thermocouple, there is a risk that the measuring element will come in direct contact with the surface of the mold member to cause a trace of a shape to remain on the surface of the mold member.

Here, a method of specifying a surface temperature of the mold member in the process is described. In the description, a process model consisting of an insert temperature reaching step, an insert inserting step, a transferring step, an insert separating step, and an insert temperature measuring step is used. The insert temperature reaching step is a step of adjusting a temperature of an insert inserted into the electrophotographic photosensitive member to a desired temperature. The insert inserting step is a step of inserting the insert into the cylindrical electrophotographic photosensitive member. The transferring step is a step of contacting a mold member having a concavo-convex shape on its surface (hereinafter, also simply referred to as "mold member") with the surface of the electrophotographic photosensitive member supported by the insert inserted thereinto in a state in which the temperature of the mold member is adjusted to the desired temperature. In this step, the concave-convex shape of the mold member is transferred to the surface of the electrophotographic photosensitive member. The insert separating step is a step of taking out and separating the insert from the electrophotographic photosensitive member. The insert temperature measuring step is a step of measuring a temperature of the insert.

The surface temperature of the mold member is Tm ° C., a reaching temperature of the insert in the insert temperature reaching step is T1° C., and a temperature of the insert in the insert temperature measuring step is T2° C. Further, a time taken from the insert temperature reaching step to the insert inserting step is t1 sec, and a time taken from the insert inserting step to the transferring step is t2 sec. A time taken from the transferring step to the insert separating step is t3 sec, and a time taken from the insert separating step to the insert temperature measuring step is t4 sec. Further, a temperature change rate of the insert at t1 sec is A1° C./sec, a temperature change rate of the insert at t2 sec is A2° C./sec, a temperature change rate of the insert at t3 sec is A3° C./sec, and a temperature change rate of the insert at t4 sec is A4° C./sec. Each of the temperature change rates is an absolute value. Further, when a ratio of a difference between the surface temperature of the mold member and the temperature of the insert to a temperature change amount of the insert by the transferring in the transferring step is R, the surface temperature of the mold member can be specified as follows:

$$Tm=T2+t3\times A3+t4\times A4+(T2+t3\times A3+t4\times A4-(T1-(t1\times A1+t2\times A2)))\times R.$$

This calculation is based on the idea that the temperature of the mold member is specified by obtaining a change amount of the temperature of the insert mainly changed by the contact with the mold member while accompanying the electrophotographic photosensitive member in the transferring step. For this reason, the first half of the equation (T2+t3×A3+t4×A4) is an equation for calculating the temperature immediately after the insert comes into contact with the mold member while companying with the electrophotographic photosensitive member. Further, in the first half, t3×A3+t4×A4 is to calculate a loss amount in the temperature of the insert up to the insert temperature measuring step after the transferring step is terminated. This temperature is a temperature to be interpolated in order to specify the temperature of the insert immediately after contact with the mold member. The second half (T1−(t1×A1+t2×A2)) is an equation for calculating a temperature of the insert immediately before the insert comes in contact with the mold member while accompanying the electrophotographic photosensitive member. Further, in the second half, (t1×A1+t2×A2) is to calculate a loss amount in the temperature of the insert up to the transferring step after the insert temperature reaching step is terminated. This temperature is a temperature to be interpolated in order to specify the temperature of the insert immediately before contact with the mold member. In addition, a change amount of the temperature of the insert calculated as described above and changed by a contact with the mold member while accompanying the electrophotographic photosensitive member in the transferring step is multiplied by the ratio R of the temperature change of the insert and the mold member by the transferring. Further, the surface temperature of the mold member can be specified by adding the difference between the obtained temperature of the insert and the surface temperature of the mold member to the insert.

<Configuration of Electrophotographic Photosensitive Member>

The cylindrical electrophotographic photosensitive member according to the present invention includes a support and a photosensitive layer formed on the support. Examples of the photosensitive layer may include a mono-layer photosensitive member containing a charge transporting material and a charge generating material in the same layer and a multilayer type (function separation type) photosensitive layer divided into a charge generating layer containing a charge generating material and a charge transporting layer containing a charge transporting material. In view of electrophotographic characteristics, the multilayer type photosensitive layer is preferable. Further, the charge generating layer may have a multilayer structure or the charge transporting layer may have a multilayer structure.

As the support, a support having conductivity (conductive support) is preferable. Examples of a material of the support can include metals (alloys) such as iron, copper, gold, silver, aluminum, zinc, titanium, lead, nickel, tin, antimony, indium, chromium, an aluminum alloy, stainless steel and the like. In addition, it is also possible to use a metal support or a plastic support having a film formed by vacuum deposition using aluminum, an aluminum alloy, an indium oxide-tin oxide alloy or the like. Further, it is also possible to use a support obtained by impregnating conductive particles such as carbon black, tin oxide particles, titanium oxide particles, silver particles or the like into plastic or paper, or a support made of a conductive binder resin.

A surface of the support may be subject to cutting treatment, roughening treatment, alumite treatment or the like for the purpose of suppressing interference fringes due to scattering of laser light.

An electroconductive layer may be formed between the support and an undercoat layer or photosensitive layer (a charge generating layer, a charge transporting layer) to be described below, for the purpose of suppressing interference fringes by scattering of laser light and coating scratches on the support.

The electroconductive layer can be formed by coating a coating liquid for an electroconductive layer obtained by dispersing conductive particles together with a binder resin and a solvent to form a coating film and drying and/or curing the obtained coating film.

Examples of the conductive particles used in the electroconductive layer can include carbon black particles, acetylene black particles, metal particles made of aluminum, nickel, iron, nichrome, copper, zinc, silver or the like, and metal oxide particles made of zinc oxide, titanium oxide, tin oxide, antinomy oxide, indium oxide, bismuth oxide, ITO and the like. Further, indium oxide doped with tin or tin oxide doped with antimony or tantalum may also be used.

As the solvent of the coating liquid for an electroconductive layer, ether based solvents, alcohol based solvents, ketone based solvents, aromatic hydrocarbon solvents and the like can be used. A film thickness of the electroconductive layer is preferably 0.1 μm or more and 50 μm or less, more preferably 0.5 μm or more and 40 μm or less and further more preferably 1 μm or more and 30 μm or less.

Examples of the binder resin used in the electroconductive layer can include polymers and copolymers of vinyl compounds such as styrene, vinyl acetate, vinyl chloride, acrylic acid esters, methacrylic acid esters, vinylidene fluoride, trifluoroethylene and the like, polyvinyl alcohol resins, polyvinyl acetal resins, polycarbonate resins, polyester resins, polysulfone resins, polyphenylene oxide resins, polyurethane resins, cellulose resins, phenolic resins, melamine resins, silicon resins, epoxy resins, and isocyanate resins.

An undercoat layer (intermediate layer) may be formed between the support or the electroconductive layer and the photosensitive layer (charge generating layer and charge transporting layer).

The undercoat layer can be formed by applying a coating liquid for an undercoat layer obtained by dissolving a binder resin in a solvent to form a coating film and drying the obtained coating film.

Examples of the binder resin used for the undercoat layer can include polyvinyl alcohol resins, poly-N-vinylimidazole, polyethylene oxide resins, ethylcellulose, ethylene-acrylic acid copolymers, casein, polyamide resins, N-methoxymethylated 6 nylon resins copolymerized nylon resins, phenolic resins, polyurethane resins, epoxy resins, acrylic resins, melamine resins, and polyester resins.

The undercoat layer may further contain metal oxide particles. Examples of the metal oxide particles can include particles containing titanium oxide, zinc oxide, tin oxide, zirconium oxide and aluminum oxide. Further, the metal oxide particles may be metal oxide particles having surfaces treated with a surface treating agent such as a silane coupling agent or the like.

As the solvent used in the coating liquid for an undercoat layer, organic solvents such as alcohol based solvents, sulfoxide based solvents, ketone based solvents, ether based solvents, ester based solvents, aliphatic halogenated hydrocarbon based solvents, aromatic compounds and the like. A film thickness of the undercoat layer is preferably 0.05 μm or more and 30 μm or less, and more preferably 1 μm or more and 25 μm or less. The undercoat layer may further contain organic resin fine particles or a leveling agent.

Examples of the charge generating material used in the photosensitive layer can include pyrylium, thiapyrylium dyes, phthalocyanine pigments, anthanthrone pigments, dibenzopyrene quinone pigments, pyranthrone pigments, azo pigments, indigo pigments, quinacridone pigments, asymmetric quinocyanine pigments, quinocyanine pigments and the like. One of these charge generating materials may be used alone or two or more thereof may also be used.

Examples of the charge transporting material used in the photosensitive layer can include hydrazone compounds, N,N-dialkylaniline compounds, diphenylamine compounds, triphenylamine compounds, triphenylmethane compounds, pyrazoline compounds, styryl compounds, stilbene compounds and the like.

When the photosensitive layer is the multilayer type photosensitive layer, the charge generating layer can be formed by applying a coating liquid for a charge generating layer obtained by dispersing the charge generating material together with a binder resin and a solvent to form a coating film and drying the obtained coating film. A mass ratio of the charge generating material and the binder resin is preferably in a range of 1:0.3 to 1:4.

Examples of a dispersion treatment method can include methods using a homogenizer, ultrasonic dispersion, a ball mill, a vibrating ball mill, a sand mill, an attritor, a roll mill and the like.

The charge transporting layer can be formed by applying a coating liquid for a charge transporting layer obtained by dissolving a charge transporting material and a binder resin in a solvent to form a coating film and drying the formed coating film.

Examples of the binder resin used in the charge generating layer and the charge transporting layer can include polymers of vinyl compounds, polyvinyl alcohol, polyvinyl acetal, polycarbonate, polyester, poly sulfone, polyphenylene oxide, polyurethane, cellulose resins, phenolic resins, melamine resins, silicon resins, epoxy resins and the like.

A film thickness of the charge generating layer is preferably 5 μm or less, and more preferably 0.1 μm or more and 2 μm or less.

A film thickness of the charge transporting layer is preferably 5 μm or more and 50 μm or less, and more preferably 10 μm or more and 35 μm or less.

Further, a protective layer containing conductive particles or a charge transporting material and a binder resin may be formed on the photosensitive layer (the charge transporting layer in the case of the multilayer photosensitive layer). In the case in which the protective layer is formed, the protective layer is a surface layer, and in the case in which the protective layer is not formed, the photosensitive layer is a surface layer. The protective layer may further contain an additive such as a lubricant and the like. Further, the resin (binder resin) itself of the protective layer may have conductivity or a charge transporting property. In this case, the protective layer may not contain conductive particles or a charge transporting material other than the corresponding resin. Further, the binder resin of the protective layer may be a thermoplastic resin or a curable resin obtained by curing with heat, light or radiation (electron beam or the like). A film thickness of the protective layer is preferably 0.1 μm or more and 30 μm or less, and more preferably 1 μm or more and 10 μm or less.

An additive can be added to each of the layers of the electrophotographic photosensitive member. Examples of the additive can include deterioration inhibitors such as antioxidants and ultraviolet absorbers, organic resin particles such as fluorine atom-containing resin particles and acrylic resin particles, inorganic particles such as silica, titanium oxide and alumina and the like.

<Configurations of Process Cartridge and Electrophotographic Apparatus>

Figure 9:
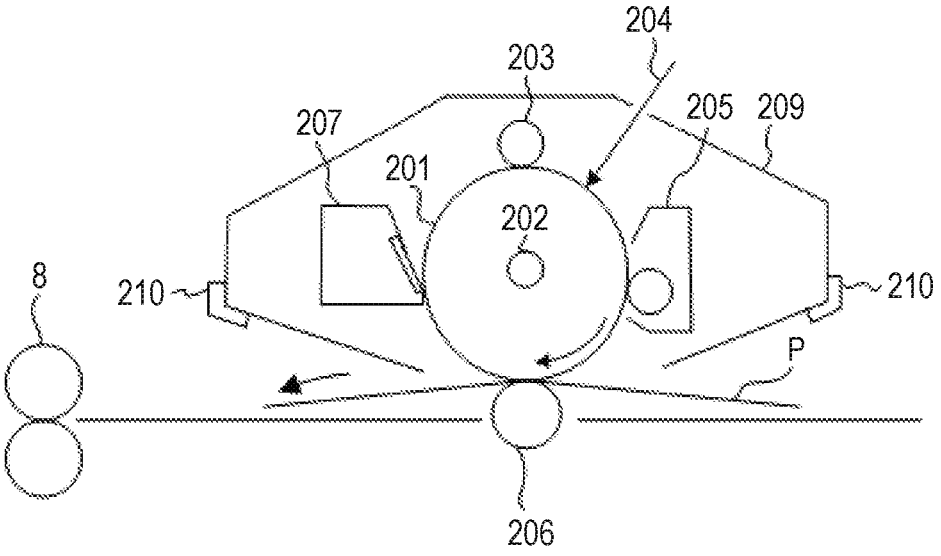
FIG. 9 is a view illustrating an example of an electrophotographic apparatus including a process cartridge having the electrophotographic photosensitive member according to the present invention.

FIG. 9 illustrates an example of an electrophotographic apparatus including a process cartridge having the electrophotographic photosensitive member according to the present invention.

In FIG. 9, a cylindrical electrophotographic photosensitive member 201 according to the present invention is driven to rotate around an axis 202 in an arrow direction at a predetermined peripheral speed (process speed). A surface of the electrophotographic photosensitive member 201 is uniformly charged to a predetermined positive or negative potential by a charging unit 203 (primary charging unit: for example, a charging roller or the like) in a rotating process. Subsequently, the uniformly charged surface of the electrophotographic photosensitive member 201 receives exposure light (image exposure light) 204 irradiated from an exposing unit (image exposure unit, not illustrated). In this way, an electrostatic latent image corresponding to target image information is formed on the surface of the electrophotographic photosensitive member 201.

In the present invention, the effect is particularly large in the case of using a charging unit utilizing discharge.

Then, the electrostatic latent image formed on the surface of the electrophotographic photosensitive member 201 is developed (normally developed or reversely developed) to a toner of a developing unit 205 to form a toner image. The toner image formed on the surface of the electrophotographic photosensitive member 201 is transferred to a transfer material P by a transfer bias from a transferring unit 206 (for example, transferring roller and the like). Here, the transfer material P is taken out from a transfer material supplying unit (not illustrated) to thereby be fed in sync with the rotation of the electrophotographic photosensitive member 201 between the electrophotographic photosensitive member 201 and the transferring unit 206 (contact portion). Further, a bias voltage having a polarity opposite to that of charges of toner is applied to the transferring unit from a bias power source (not illustrated).

The transfer material P to which the toner image has been transferred is separated from the surface of the electrophotographic photosensitive member, conveyed to a fixing unit 208, and subjected to fixing processing of the toner image, such that the transfer material P is printed out as an image formation object (print or copy) outside the electrophotographic apparatus.

After transferring the toner image, adhered substances such as transfer residual toner or the like on the surface of the electrophotographic photosensitive member 201 is removed by a cleaning unit 207 having a cleaning blade, such that the surface of the electrophotographic photosensitive member 201 is cleaned. Further, the cleaning blade is disposed to contact (abuts) substantially the entire surface of the electrophotographic photosensitive member 201 in a generatrix direction of the electrophotographic photosensitive member 201. Further, the cleaned surface of the electrophotographic photosensitive member 201 is subjected to charge elimination treatment by pre-exposure light (not shown) from a pre-exposing unit (not shown), and then repeatedly used for image formation. Further, as illustrated in FIG. 9, when the charging unit 203 is a contact charging unit using a charging roller or the like, the pre-exposing unit is not necessarily required. In the present invention, since the specific electrophotographic photosensitive member 201 is used, a friction force between the surface of the electrophotographic photosensitive member and the cleaning blade is reduced, thereby making it possible to suppress abrasion of a tip of the cleaning blade and maintain satisfactory cleaning performance for a long period of time.

In the present invention, a plurality of constitution components selected from the electrophotographic photosensitive member 201, the charging unit 203, the developing unit 205, the transferring unit 206, the cleaning unit 207 and the like are accommodated in a container to thereby be integrally supported as a process cartridge. In addition, this process cartridge can be detachably attached to a main body of the electrophotographic apparatus such as a copying machine or a laser beam printer. In FIG. 9, the electrophotographic photosensitive member 201, the charging unit 203, the developing unit 205, and the cleaning unit 207 are integrally supported in a cartridge form, thereby constituting a process cartridge 209 detachably attached to the main body of the electrophotographic apparatus using a guide unit 210 such as a rail of the main body of the electrophotographic apparatus.

The exposure light 204 is reflected light or transmitted light from the document when the electrophotographic apparatus is a copying machine or a printer. Alternatively, the exposure light 204 is light irradiated by reading a document with a sensor, converting it into a signal, scanning a laser beam depending on this signal, driving an LED array or a liquid crystal shutter array, or the like.

According to the present invention, the electrophotographic photosensitive member capable of reducing the frictional force between the surface of the electrophotographic photosensitive member and the cleaning blade and equalizing the stress applied to the cleaning blade to thereby extend the lifespan of the cleaning blade, the process cartridge, and the electrophotographic apparatus is provided.

Hereinafter, the present invention is described in more detail with respect to specific Examples. Further, the term "part" in Examples means "parts by mass". In addition, hereinafter, an electrophotographic photosensitive member is also simply referred to as a "photosensitive member".

(Preparation Example of Photosensitive Member)

An aluminum cylinder having a diameter of 29.92 mm and a length of 357.5 mm was used as a cylindrical substrate 2 (cylindrical support).

Next, as the metal oxides, 100 parts of zinc oxide particles (specific surface area: 19 $m^2/g$, powder resistance: 4.7×106 Ω·cm) were mixed and stirred with 500 parts of toluene. To this mixture, 0.8 parts of a silane coupling agent (compound name: N-2-(aminoethyl)-3-aminopropylmethyl dimethoxysilane, trade name: KBM602, manufactured by Shin-Etsu Chemical Co., Ltd.) was added, followed by stirring for 6 hours. Thereafter, toluene was evaporated off under reduced pressure and dried by heating at 130° C. for 6 hours, thereby obtaining surface-treated zinc oxide particles.

Next, 15 parts of a butyral resin (trade name: BM-1, manufactured by Sekisui Chemical Co., Ltd.) as a polyol resin and 15 parts of blocked isocyanate (trade name: Sumidur 3175, manufactured by Sumitomo Bayern Urethane Co., Ltd.) were prepared. These materials were dissolved in a mixed solution of 73.5 parts of methyl ethyl ketone and 73.5 parts of 1-butanol. To this solution, 80.8 parts of the surface-treated zinc oxide particles and 0.8 parts of 2,3,4-trihydroxybenzophenone (manufactured by Tokyo Chemical Industry Co., Ltd.) were added, and the mixture was dispersed with a sand mill apparatus using glass beads having a diameter of 0.8 mm at 23±3° C. for 3 hours. After dispersion, 0.01 part of silicone oil (trade name: SH28PA, manufactured by Dow Corning Toray Silicone Co., Ltd.) and 5.6 parts of crosslinked polymethyl methacrylate (PMMA) particles (trade name: TECHPOLYMER SSX-102, manufactured by Sekisui Plastics Co., Ltd., average primary particle size: 2.5 μm) were added thereto and stirred therewith, thereby preparing a coating liquid for an undercoat layer. This coating liquid for an undercoat layer was dip-coated on the cylindrical substrate 2 and the obtained coating film was dried at 160° C. for 40 minutes, thereby forming an undercoat layer having a film thickness of 18 μm.

Next, 20 parts of a crystalline hydroxygallium phthalocyanine crystal (charge generating material) having strong peaks at Bragg angles (28±0.2°) of 7.4° and 28.2° in the CuKα characteristic X-ray diffraction, 0.2 parts of a calixarene compound represented by the following Structural Formula (A), 10 parts of polyvinyl butyral (trade name: S-LEC BX-1, manufactured by Sekisui Chemical Co., Ltd.), and 600 parts of cyclohexanone were prepared. After these materials were placed in a sand mill using glass beads having a diameter of 1 mm and dispersed for 4 hour, 700 parts of ethyl acetate were added thereto, thereby preparing a coating liquid for a charge generating layer. This coating liquid for a charge generating layer was dip-coated on the undercoat layer, and the obtained coating film was dried at 80° C. for 15 minutes, thereby forming a charge generating layer having a film thickness of 0.17 μm.

(A)

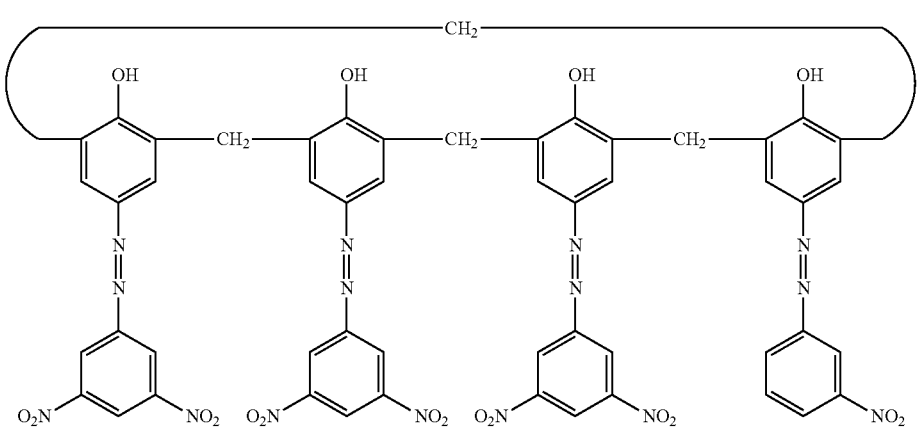

Next, 30 parts of a compound (charge transporting material) represented by the following Structural Formula (B), 60 parts of parts of a compound (charge transporting material) represented by the following Structural Formula (C) 10 parts of a compound represented by the following Structural Formula (D), 100 parts of a polycarbonate resin (trade name: Iupilon Z400, manufactured by Mitsubishi Engineering-Plastics Corporation, bisphenol Z type polycarbonate), and 0.02 parts of polycarbonate (viscosity average molecular weight Mv: 20000) represented by the following Structural Formula (E) were prepared. These materials were dissolved in a mixed solvent of 600 parts of mixed xylene and 200 parts of dimethoxymethane, thereby preparing a coating liquid for a charge transporting layer. This coating liquid for a charge transporting layer was dip-coated on the charge generating layer, and the obtained coating film was dried at 100° C. for 30 minutes, thereby forming a charge transporting layer having a film thickness of 18 μm.

(B)

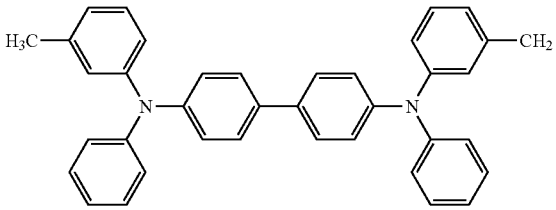

(C)

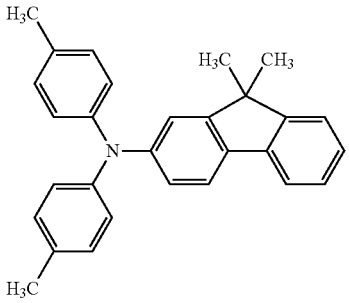

-continued (D)

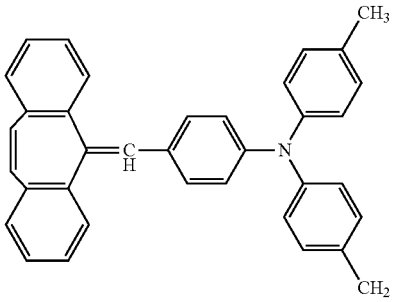

(E)

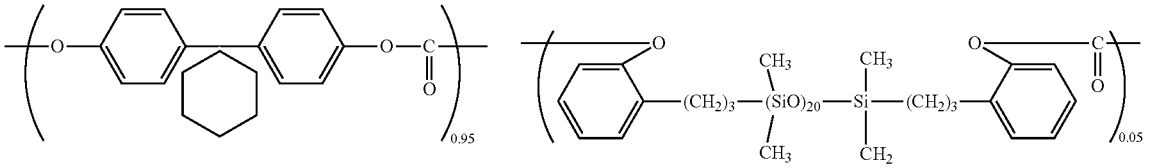

(In Formula (E), 0.95 and 0.05 are molar ratios (copolymerization ratios) of two structural units.)

Next, a mixed solvent of 20 parts of 1,1,2,2,3,3,4-heptafluorocyclopentane (trade name: Zeolora H, manufactured by Zeon Corporation) and 20 parts of 1-propanol was filtered with a polyflon filter (trade name: PF-040, manufactured by Advantec Toyo Kaisha, Ltd.). Thereafter, 90 parts of a hole transporting compound (charge transporting material) represented by the following Structural Formula (F), 70 parts of 1,1,2,2,3,3,4-heptafluorocyclopentane and 70 parts of 1-propanol were added to the mixed solvent. The resultant was filtered with a polyflon filter (trade name: PF-020, manufactured by Advantec Toyo Kaisha, Ltd.), thereby preparing a coating liquid for a second charge transporting layer (protective layer). This coating liquid for a second charge transporting layer was dip-coated on the charge transporting layer, and the obtained coating film was dried at 50° C. for 6 minutes in the air. Thereafter, while rotating the support (irradiated object) at 200 rpm under a nitrogen atmosphere, the coating film was irradiated with an electron beam for 1.6 seconds under conditions of an acceleration voltage of 70 kV and an absorption dose of 8000 Gy. Subsequently, the temperature was raised from 25° C. to 125° C. under the nitrogen atmosphere over 30 seconds to heat the coating film. At the time of irradiating the electron beam and heating, a concentration of oxygen in the atmosphere was 15 ppm. Next, heat treatment was performed thereon in the air at 100° C. for 30 minutes, thereby forming a second charge transporting layer (protective layer) having a film thickness of 5 μm and cured by the electron beam.

(F)

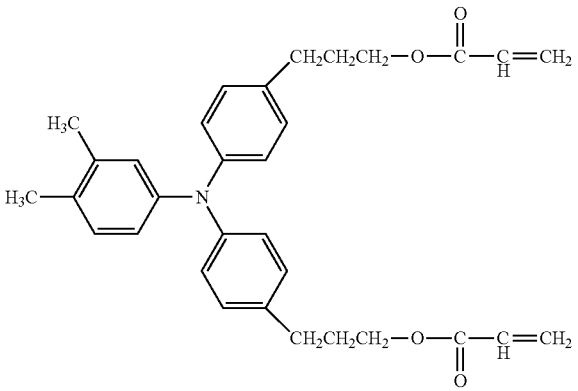

The coating films of all the layers coated in the preparation in the present Examples were released using a solvent at the lower end in a coating pulling direction at the end of each coating step. Further, coating regions of all the layers were made 1 mm from an upper end portion of the cylindrical substrate 2 and 1 mm from a lower end portion in the coating pulling direction.

In this way, a cylindrical electrophotographic photosensitive member (electrophotographic photosensitive member before forming a shape) before forming a shape on a surface thereof was manufactured.

Example 1

(Surface Processing)

An insertion member 4 as illustrated in FIG. 6A was inserted into the cylindrical electrophotographic photosensitive member 1 obtained as described above in a state in which the insertion member was heated to 55° C. in advance. At the time of insertion, the insertion member 4 was inserted so that a central position of the electrophotographic photosensitive member 1 in an axial direction and a central position of the insertion member 4 coincided with each other. As a material of the insertion member, cemented carbide mainly made of tungsten carbide and having a longitudinal elastic modulus of 540×103 N/mm$^2$ was used.

On a support member 9, the members were arranged in the order of a mold member 5, a metal layer 6, an elastic layer 7, and a positioning member 8 in order from the closest to the electrophotographic photosensitive member 1 which is the transfer object. A material of the support member 9 was SUS430, and a heater for heating was installed inside. Further, a slide mechanism moving the Y direction of FIG. 6A was installed in the support member 9. Electroless nickel plating was performed on a surface of a plate (thickness: 6 mm) made of SS400, and this plate was used as the positioning member 8. As the elastic layer 7, silicone rubber having a thickness of 8 mm was used. As the metal layer 6, a flat plate having a thickness of 2 mm and made of SUS301CSP-3/4H was used.

Here, the mold member 5 used in Example is described. As the mold member 5, a flat plate mold having a thickness of 300 μm and made of nickel as illustrated in FIGS. 7A to 7C was used. Further, on a surface of the mold member 5 coming in contact with the electrophotographic photosensitive member 1, illustrated in FIGS. 7A to 7C, first convex-shaped parts 51 and second convex-shaped parts 52 to be described below were formed at positions illustrated in FIGS. 7B and 7C, respectively. Further, all of the mold members 5 were used in a state in which a longitudinal direction of the mold member 5 illustrated in the drawing was placed in the axial direction of the electrophotographic photosensitive member, and a length of the first convex-shaped part 51 in the longitudinal direction was 345 mm. In addition, a length of the first convex-shaped part 51 illustrated in FIG. 7A in a transverse direction was 100 mm. Further, a length of the first convex-shaped part 51 including the second convex-shaped part 52 illustrated in FIGS. 7B and 7C in the transverse direction was 100 mm.

In Example 1, the mold member 5 illustrated in FIG. 7B was used, and a first convex-shaped part 51 and a second convex-shaped part 52, in which a convex hemispherical shape as illustrated in FIG. 7A was continuously provided over the entire surface, were disposed together on a surface of the mold member 5. A pitch X1 of all the hemispherical shapes of the first convex-shaped part 51 was 57 μm. In addition, a diameter Y1 of all the hemispherical shapes of the first convex-shaped part 51 was 50 μm, and a height Z1 thereof was 1.6 μm.

A pitch X2 of all the hemispherical shapes in a section of the second convex-shaped part 52 was 57 μm. In addition, a diameter Y2 of all the hemispherical shapes of the second convex-shaped part 52 was 50 μm. Further, a height Z2 of the hemispherical shape of the second convex-shaped part 52 was 0.5 μm. The second convex-shaped part 52, which was an arc shaped section of a perfect circle with a radius of 1000 mm and a center angle of 19.87 degrees, was an arc of which a chord length 53 was 345 mm and a height 54 was 14.99 mm, and a width 58 of the second convex-shaped part was 200 μm.

These members were fixed in a positional relationship illustrated in FIG. 6A. Further, the mold member 5 was fixed in a direction in which a left side illustrated in FIG. 7B was positioned on a left side in FIGS. 6A and 6B. Further, the mold member 5 was positioned so that in the axial direction of the electrophotographic photosensitive member 1 of FIG. 6B, both ends of the first and second convex-shaped parts 51 and 52 were positioned toward a central side of the electrophotographic photosensitive member 1 by 5.25 mm, respectively, with respect to the surface layer 3 of the electrophotographic photosensitive member 1. In addition, a temperature of the surface of the mold member 5 was raised to 150° C. using the heater of the support member 9 in a state in which an upper surface was set substantially horizontal.

In order to press the surface of the electrophotographic photosensitive member 1 against the mold member 5, a load mechanism (not illustrated) was provided at both end portions of the insertion member 4. Each load mechanism was provided with a guide rail and a ball screw in a vertical direction, and a connection support member connected to the ball screw and the guide rail and moving up and down was provided. A servomotor was connected to a lower side of the ball screw and rotated so that the connection support member was moved up and down along the guide rail. The connection support member and an end portion of the insertion member 4 were connected by a spherical joint. Further, the spherical joint and the connection support member were connected via a load cell so that a load amount applied to each of both ends of the insertion member 4 could be monitored.

In the processing of the electrophotographic photosensitive member 1, the electrophotographic photosensitive member 1 was pressed against the mold member 5 using the load mechanism, and the mold member 5 was moved in the Y direction illustrated in FIG. 6A by the slide mechanism. Therefore, while rolling the electrophotographic photosensitive member 1, a shape of the mold member 5 was transferred onto the surface of the electrophotographic photosensitive member.

In the processing, first, a position of the support member 9 was adjusted so that a left end portion of the first convex-shaped part 51 of the mold member 5 illustrated in FIGS. 7A to 7C was positioned just under the electrophotographic photosensitive member 1. Next, the insertion member 4 was moved in a direction toward the mold member 5 at a speed of 20 mm/sec (Vz1) by rotating the servomotor of the load mechanism. Thereafter, movement of the load mechanism was stopped at a point in time at which it was detected that the electrophotographic photosensitive member 1 came in contact with the mold member 5 and the load amount applied to the insertion member 4 by the load cell reached 6000 N. Next, the support member 9 was started to move at a speed of 10 mm/sec in the Y direction of FIG. 6A, and thus, the electrophotographic photosensitive member 1 was rotated in a clockwise direction as illustrated in FIG. 6A. In this manner, convex-shaped portions of the surface of the mold member 5 were transferred to the surface of the electrophotographic photosensitive member 1. Further, while maintaining that state, the slide mechanism was stopped when the slide mechanism was moved by 95 mm. Thereafter the insertion member 4 was moved at a speed of 20 mm/sec by the load mechanism in a direction in which the insertion member is spaced apart from the mold member 5, thereby separating the electrophotographic photosensitive member 1 and the mold member 5 from each other. Concave portions corresponding to the convex-shaped portions on the surface of the mold member 5 were formed on the surface of the electrophotographic photosensitive member 1 by transferring the convex-shaped portions on the surface of the mold member 5 to the surface of the electrophotographic photosensitive member 1 while rolling the electrophotographic photosensitive member 1 as described above. A cylindrical electrophotographic photosensitive member in which the concave portions were formed on the surface thereof was manufactured by the method as described above.

(Measurement of Processing Result)

Continuously, a depth and an area ratio of the concave portions formed on the surface of the electrophotographic photosensitive member 1 processed as described above were measured. A measurement method is described below.

A surface of the obtained electrophotographic photosensitive member was magnified and observed by a 50× lens with a laser microscope (trade name: VK-9500, manufactured by Keyence Corporation), and determination on the concave portions and the flat portions on the surface of the electrophotographic photosensitive member provided as described above was performed. At the time of observation, adjustments were made so that there was no tilt in the longitudinal direction of the electrophotographic photosensitive member and an apex of the arc of the electrophotographic photosensitive member was in focus in the circumferential direction. Then, images subjected to magnification observation were connected by an image connection application, thereby obtaining information on the entire surface of the electrophotographic photosensitive member. Further, image processing height data was selected by attached image analysis software, and the obtained result was subjected to filter-type median filtering (0.2 below).

The depth and the opening area of each concave portion formed on the surface of the electrophotographic photosensitive member were obtained by the observation. The results are illustrated in Table 1.

Further as a result of observing the surface of the electrophotographic photosensitive member in the same manner as described above using another laser microscope (trade name: X-200, manufactured by Keyence Corporation), the same result as those in the case of using the above-mentioned laser microscope (trade name: VK-9500, manufactured by Keyence Corporation) could be obtained. In the following examples, the laser microscope (trade name: VK-9500, manufactured by Keyence Corporation) and a 50× lens were used for observing the surface of the electrophotographic photosensitive member.

As a result of measuring the depth and the opening area of the concave portion as described above, a sum A of the opening areas of the concave portions on the surface of the electrophotographic photosensitive member whose surface was processed in Example 1 was 19,787 $mm^2$. Therefore, the sum A (expressed as "A %" in Table) of the opening areas of the concave portions with respect to a total area of the surface layer of the electrophotographic photosensitive member was 60%. Further, as a result of calculating an average value B of depths of the concave portions on the surface of the electrophotographic photosensitive member was 0.8 μm. In addition, among the concave portions, the concave portions having a depth in a range of +0.2 μm to −0.2 μm based on the average value B, that is, in Example 1, concave portions having a depth of 0.6 μm to 1.0 μm were extracted, and a sum C of opening areas of these concave portions was calculated. As a result, the sum C of the opening areas was 19,748 $mm^2$. Therefore, the sum C of the opening areas (described as "C %" in the Table) occupied 99.8% of the sum of the opening areas of the concave portions.

Hereinafter, a mesh is set on the electrophotographic photosensitive member, regions A and B were discriminated, a shape of the region B in X and Y directions was measured, quadratic function approximation was performed thereon by a least squares method, and a correlation coefficient R was calculated.

Hereinabove, a configuration of the mold member used is illustrated in Table 1 and the measurement results after processing are illustrated in Table 2.

(Evaluation)

The electrophotographic photosensitive member whose surface was processed as described above in Example 1 was mounted on a modified electrophotographic copying machine iR-ADV C5255 manufactured by Canon Inc., and slipping of the toner was evaluated. The electrophotographic photosensitive member was mounted on a drum cartridge (a charging roller cleaning brush was removed for evaluating the slipping of the toner) for the electrophotographic copying machine iR-ADV C5255 so that an upper end side of the electrophotographic photosensitive member was on a deep side of the modified electrophotographic copying machine iR-ADV C5255.

Figure 10:
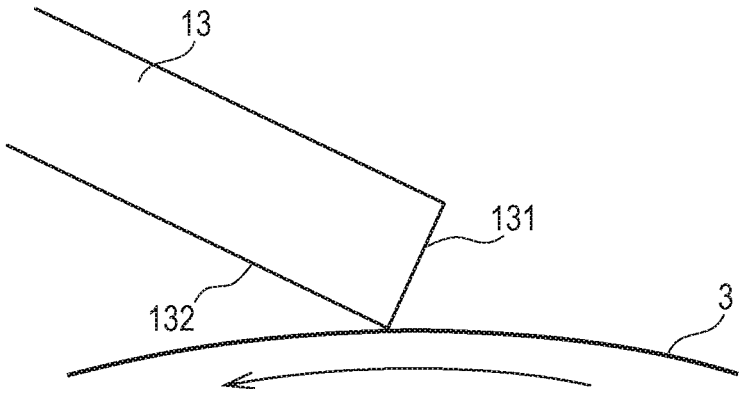
FIG. 10 is a view illustrating an example of a state in which the electrophotographic photosensitive member according to the present invention and a cleaning blade come in contact with each other.

An example of a state in which the electrophotographic photosensitive member and the cleaning blade come in contact with each other is illustrated in FIG. 10. A cleaning blade 13 (hardness: 80 JIS A°, rebound resilience at 25° C.: 35%) attached to the drum cartridge for an electrophotographic copying machine iR-ADV C5255 was used as it was. A contact angle (narrow angle) between the electrophotographic photosensitive member 1 and a blade lower surface 132 of the cleaning blade 13 was set to 25° and a contact pressure to the electrophotographic photosensitive member was set to 40 N/m.

As the toner for evaluation, a black toner having a weight average particle diameter of 5.0 μm was used.

Evaluation was carried out in an environment of 30° C./RH 80%. After continuously forming an image with an image ratio of 1% on 10,000 sheets of paper, the toner remaining on a charging roller was taped on white paper, and a density difference from the white paper was measured with a densitometer (trade name: 504 SpectroDensitometer, manufactured by X-Rite Inc.) and evaluated depending on the following criteria. A is the best as the evaluation rank and D is the worst.

A: The density difference between the toner remaining the charging roller and the white paper was less than 0.03.

B: The density difference between the toner remaining the charging roller and the white paper was 0.03 or more and less than 0.06.

C: The density difference between the toner remaining the charging roller and the white paper was 0.06 or more and less than 0.10.

D: The density difference between the toner remaining the charging roller and the white paper was 0.10 or more.

Subsequently, abrasion of the blade was evaluated using the same drum cartridge. Evaluation was conducted under the environment of 30° C./RH 80%, similarly in evaluating slipping of the toner, and an image with an image ratio of 1% was continuously formed on 90,000 sheets of paper.

Figure 11:
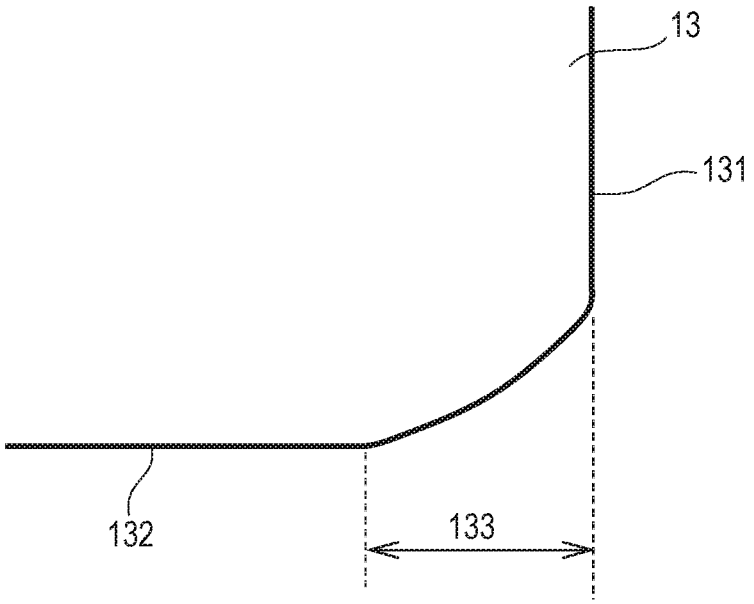
FIG. 11 is a cross-sectional view illustrating an example of an abrasion state of a tip of a cleaning blade according to the present invention.

After passing 100,000 sheets of paper in total with evaluation of slipping of the toner, the cleaning blade 13 was removed and cut into 10 equal parts in the longitudinal direction. Further, a longitudinal central portion of each blade was cut, all the cut surfaces were observed with a microscope, and an abrasion amount at the corner portion between the blade lower surface 132 and a blade front surface 131 was measured. At the time of measuring the abrasion amount, as illustrated in FIG. 11, an abrasion distance component on the surface of the blade lower surface 132 was measured. Specifically, a distance parallel to the blade lower surface 132 from an end portion of the blade front surface 131 side of the abrasion-free blade lower surface 132 to the blade front surface 131 was measured as the abrasion distance 133. As a result, in the evaluation in Example 1, an average value F1 of the abrasion distances 133 in 10 cross sections of the cleaning blade was 21.3 μm. The above-mentioned contents are illustrated in Table 3.

A: The abrasion distance of the cleaning blade was less than 25 μm.

B: The abrasion distance of the cleaning blade was 25 μm or more and less than 40 μm.

C: The abrasion distance of the cleaning blade was 40 μm or more and less than 50 μm.

D: The abrasion distance of the cleaning blade was 50 μm or more.

TABLE 1

| | Shape of First Convex-shaped Part | | | Shape of Second Convex-shaped Part | | | | | | | |
|---|---|---|---|---|---|---|---|---|---|---|---|
| | Pitch X1[μm] | Radius Y1[μm] | Height Z1[μm] | Pitch X2[μm] | Radius Y2[μm] | Height Z2[μm] | Radius [mm] | Central Angle [Degree] | Chord Length [mm] | Height of Arc [mm] | Width [μm] |
| Example 1 | 57 | 50 | 1.6 | 57 | 50 | 0.5 | 1000 | 19.87 | 345 | 14.99 | 200 |
| Example 2 | 57 | 50 | 1.6 | 57 | 50 | 0.5 | 4314 | 4.58 | 345 | 3.45 | 200 |
| Example 3 | 57 | 50 | 1.6 | 57 | 50 | 0.5 | 449 | 45.24 | 345 | 34.5 | 200 |
| Example 4 | 57 | 50 | 1.6 | 57 | 50 | 0.5 | 628 | 31.88 | 345 | 24.15 | 200 |
| Example 5 | 57 | 50 | 1.6 | 57 | 50 | 0.5 | 1443 | 13.73 | 345 | 10.35 | 200 |
| Example 6 | 57 | 50 | 6.0 | 57 | 50 | 2.0 | 1000 | 19.87 | 345 | 14.99 | 200 |
| Example 7 | 57 | 50 | 0.8 | 57 | 50 | 0.3 | 1000 | 19.87 | 345 | 14.99 | 200 |
| Example 8 | 196 | 50 | 1.6 | 196 | 50 | 0.5 | 1000 | 19.87 | 345 | 14.99 | 200 |
| Example 9 | 55 | 50 | 1.6 | 55 | 50 | 0.5 | 1000 | 19.87 | 345 | 14.99 | 200 |
| Example 10 | 81 | 50 | 3.0 | 81 | 50 | 1.0 | 1000 | 19.87 | 345 | 14.99 | 400 |
| Comparative Example 1 | 57 | 50 | 1.6 | 57 | 50 | 0.5 | 4960 | 3.98 | 345 | 3 | 200 |
| Comparative Example 2 | 57 | 50 | 1.6 | 57 | 50 | 0.5 | 442 | 45.89 | 345 | 35 | 200 |
| Comparative Example 3 | 57 | 50 | 1.6 | 57 | 50 | 0.5 | 756 | 22.84 | 300 | 15 | 200 |
| Comparative Example 4 | 57 | 50 | 1.6 | — | — | — | — | — | — | — | — |

TABLE 2

| | Concave portion on Electrophotographic Photosensitive Member | | | | | Shape of Region B | |
|---|---|---|---|---|---|---|---|
| | Total Area A[mm$^2$] | Area Ratio A[%] | First Concave Depth B[μm] | First Concave Area C[mm$^2$] | First Concave Area Ratio C[%] | Length in X Direction [mm] | Length in Y direction [mm] |
| Example 1 | 19787 | 60 | 0.8 | 19748 | 99.8 | 345 | 14.99 |
| Example 2 | 19787 | 60 | 0.8 | 19748 | 99.8 | 345 | 3.45 |
| Example 3 | 19787 | 60 | 0.8 | 19748 | 99.8 | 345 | 34.5 |
| Example 4 | 19787 | 60 | 0.8 | 19748 | 99.8 | 345 | 24.15 |
| Example 5 | 19787 | 60 | 0.8 | 19748 | 99.8 | 345 | 10.35 |
| Example 6 | 19787 | 60 | 3 | 19748 | 99.8 | 345 | 14.99 |
| Example 7 | 19787 | 60 | 0.4 | 19748 | 99.8 | 345 | 14.99 |
| Example 8 | 1649 | 5 | 0.8 | 1645 | 99.8 | 345 | 14.99 |
| Example 9 | 18265 | 65 | 0.8 | 18228 | 99.8 | 345 | 14.99 |
| Example 10 | 9893 | 30 | 1.5 | 9853 | 99.6 | 345 | 14.99 |
| Comparative Example 1 | 19787 | 60 | 0.8 | 0 | 99.8 | 345 | 3 |
| Comparative Example 2 | 19787 | 60 | 0.8 | 0 | 99.8 | 345 | 35 |
| Comparative Example 3 | 19787 | 60 | 0.8 | 0 | 99.8 | 300 | 15 |
| Comparative Example 4 | 19787 | 60 | 0.8 | 0 | 100 | — | — |

TABLE 3

| | Approximate Curve | | | | Evaluation | | | |
|---|---|---|---|---|---|---|---|---|
| | Coefficient a | Coefficient b | Coefficient c | Correlation coefficient R[−] | Short-term HH Slipping | | Long-term Blade Abrasion | |
| Example 1 | 0.00051 | 0 | 0 | 0.99 | A | 0.01 | A | 21.3 |
| Example 2 | 0.00012 | 0 | 0 | 0.99 | B | 0.05 | A | 17.0 |
| Example 3 | 0.00115 | 0 | 0 | 0.99 | A | 0.02 | B | 39.5 |
| Example 4 | 0.00081 | 0 | 0 | 0.99 | A | 0.02 | A | 24.8 |
| Example 5 | 0.00035 | 0 | 0 | 0.99 | A | 0.02 | A | 19.6 |
| Example 6 | 0.00051 | 0 | 0 | 0.99 | B | 0.03 | A | 21.9 |
| Example 7 | 0.00051 | 0 | 0 | 0.99 | A | 0.02 | A | 21.5 |
| Example 8 | 0.00051 | 0 | 0 | 0.99 | A | 0.01 | A | 19.8 |
| Example 9 | 0.00051 | 0 | 0 | 0.99 | A | 0.02 | A | 21.6 |
| Example 10 | 0.00051 | 0 | 0 | 0.99 | A | 0.02 | A | 20.4 |
| Comparative Example 1 | 0.00010 | 0 | 0 | 0.99 | D | 0.13 | A | 16.6 |

TABLE 3-continued

| | Approximate Curve | | | | Evaluation | | | |
|---|---|---|---|---|---|---|---|---|
| | Coefficient a | Coefficient b | Coefficient c | Correlation coefficient R[−] | Short-term HH Slipping | | Long-term Blade Abrasion | |
| Comparative Example 2 | 0.00117 | 0 | 0 | 0.99 | A | 0.02 | D | 59.3 |
| Comparative Example 3 | 0.00059 | 0 | 0 | 0.99 | D | 0.17 | A | 22.3 |
| Comparative Example 4 | — | — | — | — | A | 0.01 | D | 70.4 |

Examples 2 to 10 and Comparative Examples 1 to 3

A cylindrical electrophotographic photosensitive member (an electrophotographic photosensitive member before forming a shape) before forming a shape on the surface was prepared in the same manner as in Example 1, and a surface thereof was processed in the same manner as in Example 1 using a mold member having first and second convex-shaped parts illustrated in Table 1. Measurement and evaluation were performed on the electrophotographic photosensitive member after forming the shape on the surface in the same manner as in Example 1. Measurement results and evaluation results are illustrated in Tables 2 and 3, respectively.

Comparative Example 4

A cylindrical electrophotographic photosensitive member (electrophotographic photosensitive member before forming a shape) before forming a shape on a surface thereof was manufactured in the same manner as in Example 1. At the time of processing the surface, a mold member illustrated in FIG. 7A was used. Here, the used mold member had a first convex-shaped part 51 in which a convex hemispherical shape was continuously provided, and the configuration thereof is illustrated in Table 1. Except for the above-mentioned difference, the surface of the electrophotographic photosensitive member was processed, measured, and evaluated in the same manner as in Example 1. Measurement results and evaluation results are illustrated in Tables 2 and 3, respectively.

Examples 11 to 14 and Comparative Examples 5 and 6

A cylindrical electrophotographic photosensitive member (electrophotographic photosensitive member before forming a shape) before forming a shape on a surface thereof was manufactured in the same manner as in Example 1. At the time of processing the surface, a mold member illustrated in FIG. 7C was used. First and second convex-shaped parts 51 and 52 were provided at positions illustrated in FIG. 7C, respectively. Lengths of a line segment a55, a line segment b56, a line segment c57 of the second convex-shaped part 52 in FIG. 7C and a width 58 of the second convex-shaped part are illustrated in Table 4. Except for the above-mentioned difference, the surface of the electrophotographic photosensitive member was processed, measured, and evaluated in the same manner as in Example 1. Measurement results and evaluation results are illustrated in Tables 5 and 6, respectively.

TABLE 4

| | Shape of First Convex-Shaped Part | | | Shape of Second Convex-Shaped Part | | | | | | |
|---|---|---|---|---|---|---|---|---|---|---|
| | Pitch X1[μm] | Radius Y1[μm] | Height Z1[μm] | Pitch X2[μm] | Radius Y2[μm] | Height Z2[μm] | Line Segment a [mm] | Line Segment b [mm] | Line Segment c [mm] | Width [μm] |
| Example 11 | 57 | 50 | 1.6 | 57 | 50 | 0.5 | 2 | 3.45 | 310.5 | 200 |
| Example 12 | 57 | 50 | 1.6 | 57 | 50 | 0.5 | 2 | 34.5 | 310.5 | 200 |
| Example 13 | 57 | 50 | 1.6 | 57 | 50 | 0.5 | 2 | 10.35 | 345 | 200 |
| Example 14 | 57 | 50 | 1.6 | 57 | 50 | 0.5 | 2 | 24.15 | 345 | 200 |
| Comparative Example 5 | 57 | 50 | 1.6 | 57 | 50 | 0.5 | 0.5 | 15 | 345 | 200 |
| Comparative Example 6 | 81 | 50 | 3.0 | 81 | 50 | 1.0 | 0.5 | 1 | 345 | 200 |

TABLE 5

| | Concave Portion on Electrophotographic Photosensitive Member | | | | | | |
|---|---|---|---|---|---|---|---|
| | | | | | | Shape of Region B | |
| | Total Area A[mm$^2$] | Area Ratio A[%] | First Concave Depth B[μm] | First Concave Area C[mm$^2$] | First Concave Area Ratio C[%] | Length in X Direction [mm] | Length in Y Direction [mm] |
| Example 11 | 19787 | 60 | 0.8 | 19748 | 99.8 | 310.5 | 3.45 |
| Example 12 | 19787 | 60 | 0.8 | 19748 | 99.8 | 310.5 | 34.5 |
| Example 13 | 19787 | 60 | 0.8 | 19748 | 99.8 | 345 | 10.35 |

TABLE 5-continued

| | Concave Portion on Electrophotographic Photosensitive Member | | | | | | |
|---|---|---|---|---|---|---|---|
| | | | First | First | First | Shape of Region B | |
| | Total Area A[mm$^2$] | Area Ratio A[%] | Concave Depth B[μm] | Concave Area C[mm$^2$] | Concave Area Ratio C[%] | Length in X Direction [mm] | Length in Y Direction [mm] |
| Example 14 | 19787 | 60 | 0.8 | 19748 | 99.8 | 345 | 24.15 |
| Comparative Example 5 | 19787 | 60 | 0.8 | 19748 | 99.8 | 345 | 15 |
| Comparative Example 6 | 9893 | 30 | 1.5 | 9853 | 99.8 | 345 | 1 |

TABLE 6

| | Approximate Curve | | | | Evaluation | | | |
|---|---|---|---|---|---|---|---|---|
| | Coefficient a | Coefficient b | Coefficient c | Correlation coefficient R[−] | Short-term HH Slipping | | Long-term Blade Abrasion | |
| Example 11 | 0.00004 | 0 | 0 | 0.5 | C | 0.08 | A | 17.7 |
| Example 12 | 0.00042 | 0 | 0 | 0.5 | C | 0.06 | C | 45.1 |
| Example 13 | 0.00012 | 0 | 0 | 0.5 | B | 0.05 | B | 23 |
| Example 14 | 0.00029 | 0 | 0 | 0.5 | B | 0.03 | B | 27.7 |
| Comparative Example 5 | 0.00017 | 0 | 0 | 0.4 | D | 0.15 | B | 26.4 |
| Comparative Example 6 | 0.00001 | 0 | 0 | 0.4 | D | 0.13 | A | 16.9 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-200547, filed Oct. 16, 2017, which is hereby incorporated by reference herein in its entirety.

What is claimed is:

1. An electrophotographic photosensitive member having a cylindrical shape, comprising a plurality of concave portions on a surface thereof, wherein a sum of opening areas of the concave portions is 5% or more and 65% or less based on a total area of a surface layer of the electrophotographic photosensitive member, an average value davg of depths of the concave portions satisfies the following Equation (1), $$0.4 \leq davg \leq 3.0 (\mu m) \quad \text{Equation (1)}$$

a sum of opening areas of concave portions having a depth d satisfying the following Equation (2) is 95% or more of the sum of the opening areas of the concave portions, $$davg-0.2 \leq d \leq davg+0.2 (\mu m) \quad \text{Equation (2)}$$

an average value Lavg of maximum widths of openings of the concave portions in a circumferential direction of the electrophotographic photosensitive member is 20 μm or more and 200 μm or less, and the electrophotographic photosensitive member has at least one region B on the surface thereof, where (band Y0)

a band Y0 is, when an average value of maximum widths of the openings of the concave portions in an axial direction of the electrophotographic photosensitive member is defined as Wavg, an annular band including a line LY0 and having a width of 4×Wavg, the line LY0 passing through the center of the electrophotographic photosensitive member in the axial direction as a central line, (line X0)

a line X0 is, (i) when two or more shallow concave portions of which 50% or more of an opening area is included in the band Y0 and a depth is 0.5×davg or less are continuously present in the band Y0, a line in the axial direction of the electrophotographic photosensitive member, passing through a central point of a line segment and being orthogonal to the band Y0, the line segment connecting deepest positions of two concave portions positioned at both ends in the circumferential direction among the shallow concave portions that are continuously present, or (ii) when the shallow concave portion of which 50% or more of an opening area is included in the band Y0 and a depth is 0.5×davg or less is present alone in the band Y0, a line in the axial direction of the electrophotographic photosensitive member, passing through the deepest position of the shallow concave portion and being orthogonal to the band Y0, (region A)

a region A, on the surface of the electrophotographic photosensitive member, which is a tetragonal region of 200 μm square partitioned by lines in the circumferential direction which are formed in parallel to the line LY0 and arranged to have an interval of 200 μm therebetween, and lines in the axial direction which are formed in parallel to the line X0 in a region up to a position spaced apart from the line X0 by 35 mm and arranged to have an interval of 200 μm therebetween, is a tetragonal region in which a ratio of the number of shallow concave portions having a depth of 0.5×davg or less to the total number of concave portions of which 50% or more of the opening area is included in the tetragonal region is 25% or more, (region B)

a region B is a region formed by an aggregate satisfying the following condition 1 among aggregates of the region A in which any one of four sides or four corners of the region A comes in contact with each other, and (condition 1)

a length of the aggregate in the axial direction of the electrophotographic photosensitive member is 90% or more based on a maximum length of a concave portion formation region in the axial direction of the electrophotographic photosensitive member, a length of the aggregate in the circumferential direction of the electrophotographic photosensitive member is 1% or more and 10% or less based on the maximum length of the concave portion formation region in the axial direction of the electrophotographic photosensitive member, and when quadratic function approximation is performed on a central point of each of the regions A constituting the aggregate by a least squares method in an orthogonal coordinate system in which the axial direction of the electrophotographic photosensitive member is the X direction and the circumferential direction thereof is the Y direction, a correlation coefficient R of an approximate curve is 0.5 or more.

2. The electrophotographic photosensitive member according to claim 1, wherein the correlation coefficient R of the region B is 0.7 or more.

3. The electrophotographic photosensitive member according to claim 1, wherein a length of the region B in the circumferential direction is 3% or more and 7% or less based on the maximum length of the concave portion formation region in the axial direction of the electrophotographic photosensitive member.

4. An electrophotographic photosensitive member having a cylindrical shape, comprising a plurality of concave portions on a surface thereof, wherein a sum of opening areas of the concave portions is 5% or more and 65% or less based on a total area of a surface layer of the electrophotographic photosensitive member, an average value davg of depths of the concave portions satisfies the following Equation (1), $$0.4 \leq davg \leq 3.0(\mu m) \quad \text{Equation (1)}$$

a sum of opening areas of concave portions having a depth d satisfying the following Equation (2) is 95% or more of the sum of the opening areas of the concave portions, $$davg-0.2 \leq d \leq davg+0.2(\mu m) \quad \text{Equation (2)}$$

an average value Lavg of maximum widths of openings of the concave portions in a circumferential direction of the electrophotographic photosensitive member is 20 μm or more and 200 μm or less, and the electrophotographic photosensitive member has at least one arc shaped region formed by an aggregate satisfying the following condition 1 on the surface of the electrophotographic photosensitive member:

(condition 1)

the aggregate is an aggregate of shallow concave portions having a depth of 0.5×davg or less, a length of the aggregate in the axial direction of the electrophotographic photosensitive member is 90% or more based on a maximum length of a concave portion formation region in the axial direction of the electrophotographic photosensitive member, a length of the aggregate in the circumferential direction of the electrophotographic photosensitive member is 1% or more and 10% or less based on the maximum length of the concave portion formation region in the axial direction of the electrophotographic photosensitive member, and when quadratic function approximation is performed on a central point of each of the shallow concave portion constituting the aggregate by a least squares method in an orthogonal coordinate system in which the axial direction of the electrophotographic photosensitive member is the X direction and the circumferential direction thereof is the Y direction, a correlation coefficient R of an approximate curve is 0.5 or more.

5. A process cartridge integrally supporting an electrophotographic photosensitive member and a cleaning unit having a cleaning blade disposed to come in contact with the electrophotographic photosensitive member, and detachably attached to a main body of an electrophotographic apparatus, the electrophotographic photosensitive member having a cylindrical shape and comprising a plurality of concave portions on a surface thereof, wherein a sum of opening areas of the concave portions is 5% or more and 65% or less based on a total area of a surface layer of the electrophotographic photosensitive member, an average value davg of depths of the concave portions satisfies the following Equation (1), $$0.4 \leq davg \leq 3.0(\mu m) \quad \text{Equation (1)}$$

a sum of opening areas of concave portions having a depth d satisfying the following Equation (2) is 95% or more of the sum of the opening areas of the concave portions, $$davg-0.2 \leq d \leq davg+0.2(\mu m) \quad \text{Equation (2)}$$

an average value Lavg of maximum widths of openings of the concave portions in a circumferential direction of the electrophotographic photosensitive member is 20 μm or more and 200 μm or less, and the electrophotographic photosensitive member has at least one region B on the surface thereof, where (band Y0)

a band Y0 is, when an average value of maximum widths of the openings of the concave portions in an axial direction of the electrophotographic photosensitive member is defined as Wavg, an annular band including a line LY0 and having a width of 4×Wavg, the line LY0 passing through the center of the electrophotographic photosensitive member in the axial direction as a central line, (line X0)

a line X0 is, (i) when two or more shallow concave portions of which 50% or more of an opening area is included in the band Y0 and a depth is 0.5×davg or less are continuously present in the band Y0, a line in the axial direction of the electrophotographic photosensitive member, passing through a central point of a line segment and being orthogonal to the band Y0, the line segment connecting deepest positions of two concave portions positioned at both ends in the circumferential direction among the shallow concave portions that are continuously present, or (ii) when the shallow concave portion of which 50% or more of an opening area is included in the band Y0 and a depth is 0.5×davg or less is present alone in the band Y0, a line in the axial direction of the electrophotographic photosensitive member, passing through the deepest position of the shallow concave portion and being orthogonal to the band Y0, (region A)

a region A, on the surface of the electrophotographic photosensitive member, which is a tetragonal region of 200 μm square partitioned by lines in the circumferential direction which are formed in parallel to the line LY0 and arranged to have an interval of 200 μm therebetween, and lines in the axial direction which are formed in parallel to the line X0 in a region up to a position spaced apart from the line X0 by 35 mm and arranged to have an interval of 200 μm therebetween, is a tetragonal region in which a ratio of the number of shallow concave portions having a depth of 0.5×davg or less to the total number of concave portions of which 50% or more of the opening area is included in the tetragonal region is 25% or more, (region B)

a region B is a region formed by an aggregate satisfying the following condition 1 among aggregates of the region A in which any one of four sides or four corners of the region A comes in contact with each other, and (condition 1)

a length of the aggregate in the axial direction of the electrophotographic photosensitive member is 90% or more based on a maximum length of a concave portion formation region in the axial direction of the electrophotographic photosensitive member, a length of the aggregate in the circumferential direction of the electrophotographic photosensitive member is 1% or more and 10% or less based on the maximum length of the concave portion formation region in the axial direction of the electrophotographic photosensitive member, and when quadratic function approximation is performed on a central point of each of the regions A constituting the aggregate by a least squares method in an orthogonal coordinate system in which the axial direction of the electrophotographic photosensitive member is the X direction and the circumferential direction thereof is the Y direction, a correlation coefficient R of an approximate curve is 0.5 or more.

* * * * *